US011185132B2

(12) United States Patent
Athans et al.

(10) Patent No.: US 11,185,132 B2
(45) **Date of Patent: *Nov. 30, 2021**

(54) CHILD RESISTANT ZIPPER CLOSURE SYSTEM AND ROCKABLE SLIDER DEVICE AND METHODS

(71) Applicant: Reynolds Presto Products Inc., Lake Forest, IL (US)

(72) Inventors: John D. Athans, Victor, NY (US); Nicholas A. DeRue, Farmington, NY (US); Zachary R. Thompson, Canandaigua, NY (US); Gregg Thompson, Canandaigua, NY (US); Scott Snyder, Macedon, NY (US)

(73) Assignee: Reynolds Presto Products Inc., Lake Forest, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/901,577

(22) Filed: Jun. 15, 2020

(65) Prior Publication Data

US 2020/0375324 A1 Dec. 3, 2020

Related U.S. Application Data

(63) Continuation of application No. 16/051,090, filed on Jul. 31, 2018, now Pat. No. 10,681,966, which is a continuation-in-part of application No. 16/025,616, filed on Jul. 2, 2018, now abandoned.

(51) Int. Cl.
*A44B 19/26* (2006.01)
*B65D 33/25* (2006.01)

(52) U.S. Cl.
CPC ..... *A44B 19/265* (2013.01); *B65D 33/2508* (2013.01); *B65D 33/2591* (2013.01); *B65D 2215/04* (2013.01)

(58) Field of Classification Search
CPC ..... A44B 19/265; B65D 33/2508; B65D 33/2591; B65D 2215/04
USPC ..... 383/64
See application file for complete search history.

(56) References Cited

U.S. PATENT DOCUMENTS

| | | | | |
|---|---|---|---|---|
| 5,007,143 | A | 4/1991 | Herrington | |
| 5,442,838 | A | 8/1995 | Richardson et al. | |
| 5,871,281 | A | 2/1999 | Stolmeier et al. | |
| 6,287,000 | B1 | 9/2001 | Buchman | |
| 6,526,632 | B1 | 3/2003 | Blythe et al. | |
| 10,681,966 | B2 * | 6/2020 | Athans | A44B 19/265 |

(Continued)

FOREIGN PATENT DOCUMENTS

| | | | |
|---|---|---|---|
| FR | 2770493 | A1 | 5/1999 |
| JP | 2000152810 | A * | 6/2000 |

OTHER PUBLICATIONS

Machine translation FR-2770493-B1. 6pgs.
International Search Report and Written Opinion for Application No. PCT/US2019/040137 dated Sep. 23, 2019, 15 pages.

*Primary Examiner* — Jes F Pascua
(74) *Attorney, Agent, or Firm* — Merchant & Gould P.C.

(57) ABSTRACT

A slider for a zipper closure includes a separator plow that is positionable between interlocking tracks of the zipper closure to open the zipper closure by pivoting an opening end of the slider in a direction toward a notch to position the plow between the interlocking closures. The slider can be disengaged by pivoting the slider so that the plow is outside of the interlocking tracks.

20 Claims, 18 Drawing Sheets

(56) References Cited

U.S. PATENT DOCUMENTS

| | | | | |
|---|---|---|---|---|
| 2006/0168779 | A1 | 8/2006 | Chaturvedi | |
| 2014/0259559 | A1 | 9/2014 | VanLoocke | |
| 2014/0270596 | A1 | 9/2014 | Dowler et al. | |
| 2014/0298757 | A1 | 10/2014 | Chapek | |
| 2016/0338454 | A1 | 11/2016 | Chapek | |
| 2020/0002060 | A1* | 1/2020 | Athans | B65D 33/2591 |

* cited by examiner

CHILD RESISTANT ZIPPER CLOSURE SYSTEM AND ROCKABLE SLIDER DEVICE AND METHODS

This application is a continuation of Ser. No. 16/051,090, filed Jul. 31, 2018, which is a continuation-in-part of application Ser. No. 16/025,616, filed Jul. 2, 2018, each of which is incorporated herein by reference in its entirety.

TECHNICAL FIELD

This disclosure relates to a slider for a recloseable zipper closure usable with a bag or pouch. More particularly, this disclosure relates to a slider and zipper closure, in which the slider is operable by a rockable or pivoting action.

BACKGROUND

Recloseable flexible packages can be used to store various household products, in which they can be retrieved, opened, and reclosed until the contents are depleted. Opening and reclosing of these packages is easy for both adults and children. If these packages contain potentially harmful products and are accessible to young children, the ease of access presents a risk to children. As a result, there is a need to provide for a recloseable closure to increase the difficulty for children to open the bag and still provide adequate means for adults and senior citizens to open the bag.

SUMMARY

In general, a child resistant slider and closure system is provided that improves the prior art.

In one aspect, a slider for a zipper closure having a male track and a female track with complementary profiles for interlocking and unlocking is provided. The slider includes an opposite opening end and closing end; a top member; a pair of spaced legs depending from the top member, with the spaced legs defining an open volume therebetween to allow for passage of the tracks therethrough and with the legs straddling the tracks; internal surfaces spaced sufficiently close together in a vicinity of the closing end to press the profiles into interlocking relationship as the slider is moved in a closing direction along the zipper closure; and a separator plow extending from opening end. The separator plow is selectively movable into a position to be between the interlocking members and separate the interlocking profiles as the slider is moved in an opening direction along the zipper closure by pivoting the opening end of the slider in a direction toward the profiles.

The slider may further include a protrusion extending from at least one of the legs into the open volume toward the opposite leg.

The protrusion can be in the vicinity of the opening end.

In some embodiments, at least one leg has a first track-accommodating groove and a second track-accommodating groove. The first and second track-accommodating grooves are separated by the protrusion.

The first track-accommodating groove and second track-accommodating groove can be angled relative to each other at an angle greater than 0° and less than 90°.

In some embodiments, the track-accommodating groove and second track-accommodating groove can be angled relative to each other at an angle of 10-60°.

In some embodiments, the first track-accommodating groove and second track-accommodating groove can be angled relative to each other at an angle of 20-40°.

The protrusion can have a triangle-shaped periphery in some implementations.

In example embodiments, the internal surfaces that press the profiles into interlocking relationship may comprise internal surfaces of the spaced legs. The separator plow extends from the top member into the volume between the spaced legs.

In one or more example embodiments, each of the spaced legs has a hook at a free end to engage an external portion of the zipper closure to retain the slider in operative position on the zipper closure.

In many implementations, the slider can be molded as a single piece.

In some example embodiments, the slider includes a spring tab extending from the closing end and between the spaced legs.

The spring tab may be angled from the top member in a range of 15-40°, for example 20-35°.

In one or more embodiments, the spring tab extends from the top member and less than 75% of a length of the spaced legs.

In another aspect, a child resistant slider closure system is provided. The system includes a recloseable zipper closure with a male track and a female track having complementary profiles for interlocking and unlocking. A notch is located in the male and female tracks and is spaced a distance from an end of the zipper closure. A slider is slidably located on the zipper closure and has an opposite opening end and closing end. The slider includes a top member and a pair of spaced legs depending from the top member. The spaced legs define an open volume therebetween to allow for passable of the tracks therethrough and with the legs straddling the tracks. A separator plow is at the opening end. The slider is pivotable relative to the zipper closure to selectively move the separator plow into or out of a position between the interlocking members. The separator plow is positionable between the interlocking members to separate the tracks and open the zipper closure by pivoting the opening end of the slider in a direction toward the notch. The separator plow is positionable outside of the interlocking members to prevent separation of the tracks by pivoting the opening end of the slider in a direction away from the notch and outside of the tracks.

In example embodiments, the slider further includes a protrusion extending from at least one of the legs into the open volume toward the opposite leg. The slider is pivoted to selectively move the separator plow into or out of a position between the interlocking members. The protrusion engages against an external portion of the zipper closure to provide a tactile indication of a changed position of the separator plow.

At least one leg of the slider can have a first track-accommodating groove and a second track-accommodating groove, in which the first and second track-accommodating grooves are separated by the protrusion.

In example embodiments, the first track-accommodating groove and second track-accommodating groove are angled relative to each other at a first angle greater than 0° and less than 90°.

In one or more example embodiments, the zipper closure system further includes a pair of end stops at opposite ends of the zipper closure.

In some examples, the end stops comprise ultrasonically welded terminations.

In some examples, the end stops comprise flexible clips.

In one or more example embodiments, a first of the end stops in the vicinity of the notch has an angled surface extending at a non-zero and non-perpendicular angle from a top of the first end stop in a direction toward the notch.

In some examples, the angled surface of the first end stop and the first angle are within 10° of each other.

In some examples, the angled surface of the first end stop and the first angle are within 0-5° of each other.

In one or more embodiments, the angled surface of the first end stop and the first angle are each between about 20-40°.

In some implementations, the slider further includes a spring tab extending from the closing end and between the spaced legs. The separator plow extends from the top member into the open volume between the legs. When the slider is pivoted to selectively move the separator plow into a position between the interlocking members, the spring tab engages against a top of at least one of the profiles so that a user must apply a continuous force on the slider to overcome a force of the spring tab to keep the plow between the interlocking members.

The spring tab may be angled from the top member in a range of 15-40°, for example, 20-35°.

In one or more embodiments, the spring tab extends from the top member and less than 25% of a length of the spaced legs.

In another aspect, a method of operating a zippered bag having an openable and recloseable mouth is provided. The method includes providing a zippered bag having first and second panels each having a top forming the mouth, a bottom, and first and second opposing sides; a recloseable zipper closure including interlocking members with complementary profiles for interlocking and unlocking; one profile being in proximity to the top of the first panel, and the other profile being in proximity to the top of the second panel; the complementary profiles interlocking to close the mouth and unlocking to open the mouth; the zipper closure including a notch spaced a distance from the first side; a slider located on the zipper closure; and the slider having an opening and an opposite closing end, a top member, and a pair of spaced legs depending from the top member. The method further includes a step of opening the mouth by moving the slider to the notch; pivoting the opening end of the slider toward the notch to position a separator plow extending from the opening end of the slider between the interlocking members; and while the plow is between the interlocking members, moving the slider in an opening direction along the zipper closure to result in separation of the interlocking profiles.

In example methods, the step of pivoting includes moving a protrusion extending from one of the legs over an external portion of the zipper closure to receive a tactile indication the plow has been moved to the position between the interlocking members.

Some example methods further include a step of closing the mouth by moving the slider in a direction toward the notch along the zipper closure.

The method can further include a step of disabling the slider from being able to open the mouth by moving the slider to the notch; engaging the opening end of the slider against an end stop positioned at an end of the zipper closure; and using the end stop to guide the slider in a pivoted motion to pivot the opening end away from the notch and move the plow from between the interlocking members.

In some example methods, the step of providing a slider on the zipper closure includes providing the slider in which a spring tab extends from the closing end and between the spaced legs, the spring tab exerting a force against a top of at least one of the profiles. The step of moving the slider in an opening direction along the zipper closure includes applying a continuous force on the slider to overcome the force the spring tab exerts against a top of at least one of the profiles to keep the plow between the interlocking members.

A variety of examples of desirable product features or methods are set forth in the description that follows, and in part, will be apparent from the description or maybe learned by practicing various aspects of this disclosure. The aspects of this disclosure may relate to individual features as well as combinations of features. It is to be understood that both the foregoing general description and the following detailed description are explanatory only, and are not restrictive of the claimed invention.

DETAILED DESCRIPTION

A. Example Package Enclosure

Figure 1:
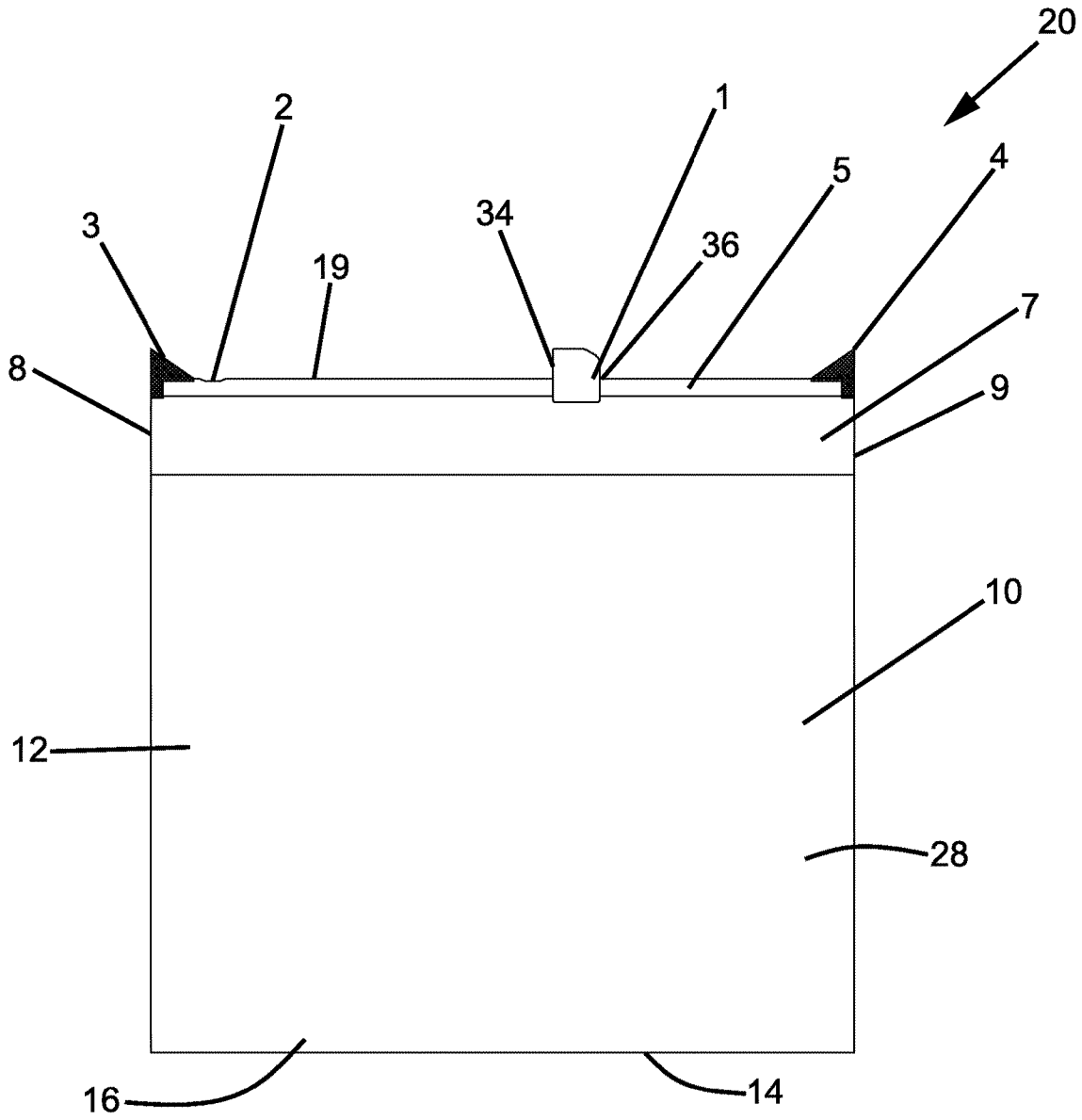
FIG. 1 is a front view of a flexible package having a recloseable zipper closure and slider, constructed in accordance with principles of this disclosure.

FIG. 1 is one example embodiment of a packaging arrangement in the form of a recloseable pouch or bag, including a flexible package 20. The package 20 can be a polymeric package, such as a plastic bag 10 having a recloseable closure in the form of a plastic zipper closure 7, which is "child resistant." By "child resistant", it is meant that to the closure is a challenge to open to a young child, while being feasible for adults and senior citizens to open. In general, international and national child resistant packaging testing protocols consider a child to be young if the child is under the age of fifty-two months.

Also shown in FIG. 1 is a slider 1 for opening and closing the zipper closure 7. The slider 1 is in the child resistant closure 7, as described further below. Preferably, the sliders 1 described herein are molded as a single piece of plastic, although many alternatives are possible, including having the slider be multiple pieces.

The package 20 can be many different arrangements. In the example shown, the package 20 includes opposing panel sections 12, 13 (FIG. 13), typically made from a flexible polymeric plastic film. Some manufacturing techniques heat seal together the first and second panel sections 12, 13 along two side edges 8, 9 and meet at a fold line 14 in order to form a three-edged containment section 28 for a product within an interior of the package 20.

In the embodiment shown, the fold line 14 comprises a bottom edge 16 of the package 20. Access is provided to the interior of the package through an open mouth 18 (FIG. 6) along a top edge 19 of the package 20. In this embodiment, the mouth 18 extends the width of the package 20 between the side edges 8, 9. The mouth 18 is depicted as being opposite of the bottom edge 16. In other embodiments, the panel sections 12, 13 can be heat sealed together along the bottom edge 16, as well as the side edges 8, 9. Many alternatives are possible. For example, the package 20 can include gussets along the side or bottom, or both.

Figure 6:
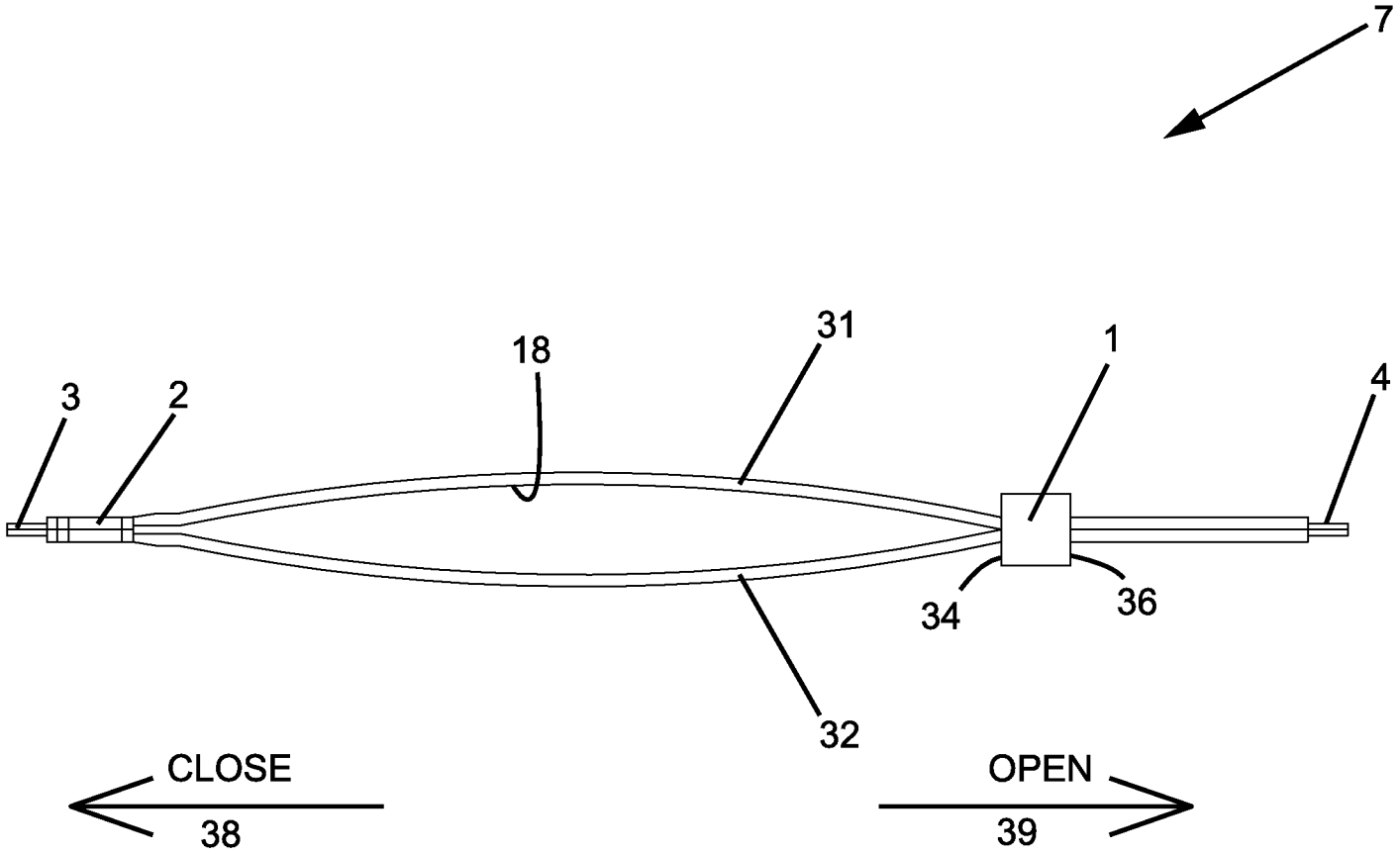
FIG. 6 is a top view of the package of FIG. 5 showing the slider as it is opening the zipper closure.
Figure 7:
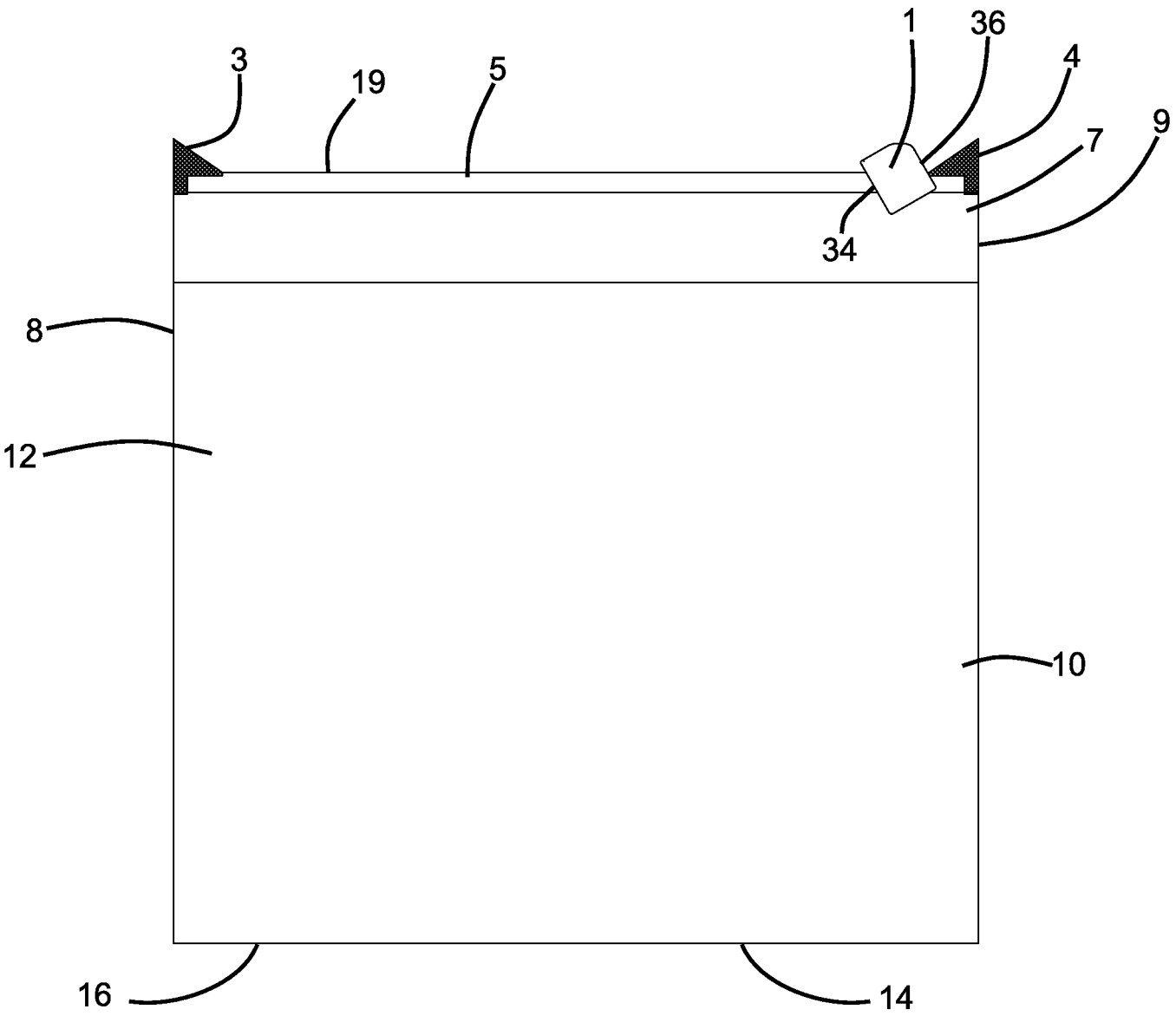
FIG. 7 is a front view of the flexible package of FIG. 5 and showing the slider at an end of the closure with the closure being fully opened.
Figure 13:
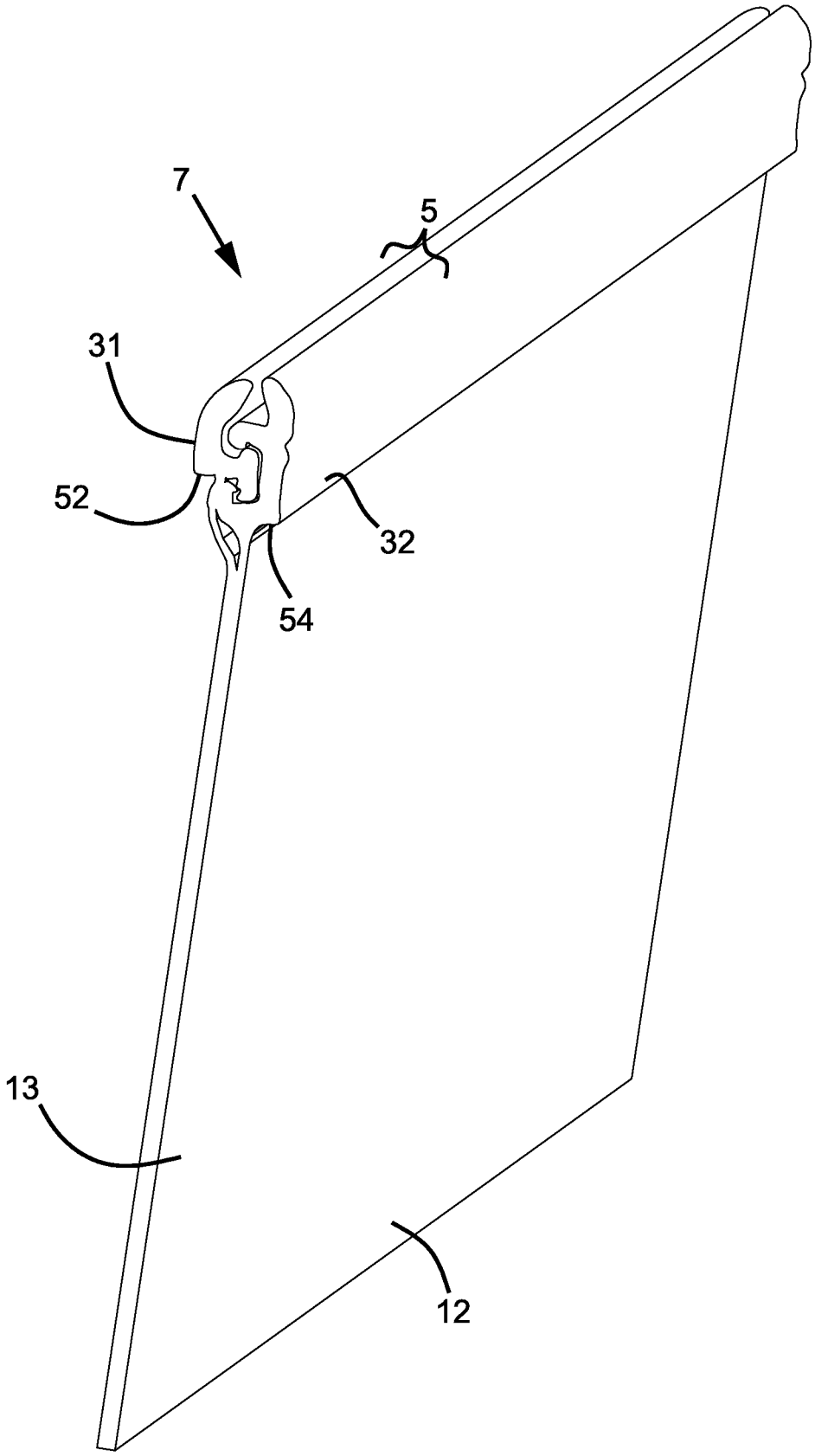
FIG. 13 is a perspective view of one example embodiment of a zipper closure showing the profiles and usable with the slider of the previous FIGS.

The zipper closure 7 is shown in the example of embodiment of FIG. 1 along the top edge 19. In other embodiments, the zipper closure 7 could be positioned on the package 20 at a location different from the top edge 19, depending upon the application needs of the package 20. The zipper closure 7 may be many different types of zipper closures. In one example, the zipper closure 7 has complementary profiles for interlocking and unlocking including a first interlocking member 31 (FIGS. 6 and 13) and a second interlocking member 32 (FIGS. 6 and 13). The interlocking member 31 and interlocking member 32 have complementary cross-sectional shapes and are closed by pressing together. Usable example profiles are described in U.S. Pat. 5,442,838, or U.S. Pat. 5,007,143, each of which is incorporated herein by reference. Many alternatives are possible.

The zipper closure 7 includes a notch 2. The notch 2 will typically be spaced a distance from an end termination or stop 3 of the zipper closure 7, as well as from the edge 8 of the package 20. As will be described further below, the notch 2 is provided to allow the user of the package 20 to position a portion of the slider 1 between the interlocking members 31, 32 and allow the interlocking members 31, 32 to be separated to open the mouth 18.

The zipper closure 7 has at opposite ends, terminations or end stops 3, 4. The termination 3 is also along the side edge 8, while the termination 4 is along the side edge 9, although the end terminations 3, 4 do not necessarily need to be at the side edges 8, 9. Many different types of terminations are possible, and in this embodiment, the terminations are from ultrasonic crushing or welded terminations. Other types of terminations are usable, including flexible clips 103, 104, described in conjunction with the embodiment of FIGS. 8-12. The flexible clips 103, 104 can be mounted on the closure profiles 5 automatically with suitable insertion equipment, or manually. The end clips 103, 104 are wrapped around the profile 5 and fused thereon ultrasonically or with heat. The flexible clips 103, 104 can be injection molded pieces.

B. Example Embodiment of Slider 1

Figure 2:
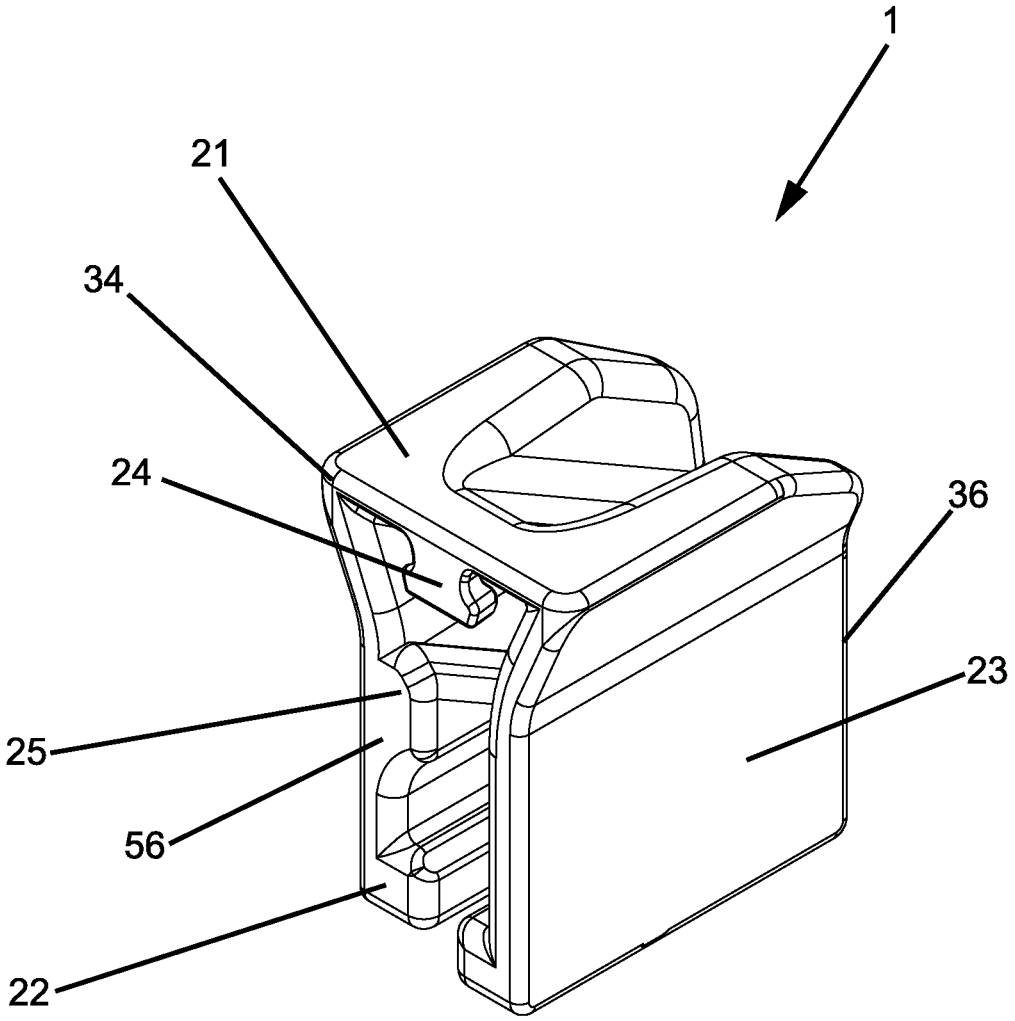
FIG. 2 is a perspective view of a first embodiment of a slider, used with the zipper closure of FIG. 1, constructed in accordance with principles of this disclosure.

A first embodiment of a child resistant slider is shown in FIG. 2 at reference numeral 1. The slider 1 is slidably located on the child resistant zipper closure 7 of FIG. 1. The slider 1 includes an opening end 34 and an opposite closing end 36. The opening end 34 is the end of the slider 1 that trails when the zipper closure 7 is being moved in the opening direction shown at arrow 39 of FIG. 6. The closing end 36 is the end of the slider 1 that trails when the slider 1 is being moved in the closing direction shown at arrow 38 of FIG. 6. As described further below, there is structure at the opening end 34 for separating the tracks 31, 32, and there is structure at the closing end 36 for pressing together the tracks 31, 32.

Figure 3:
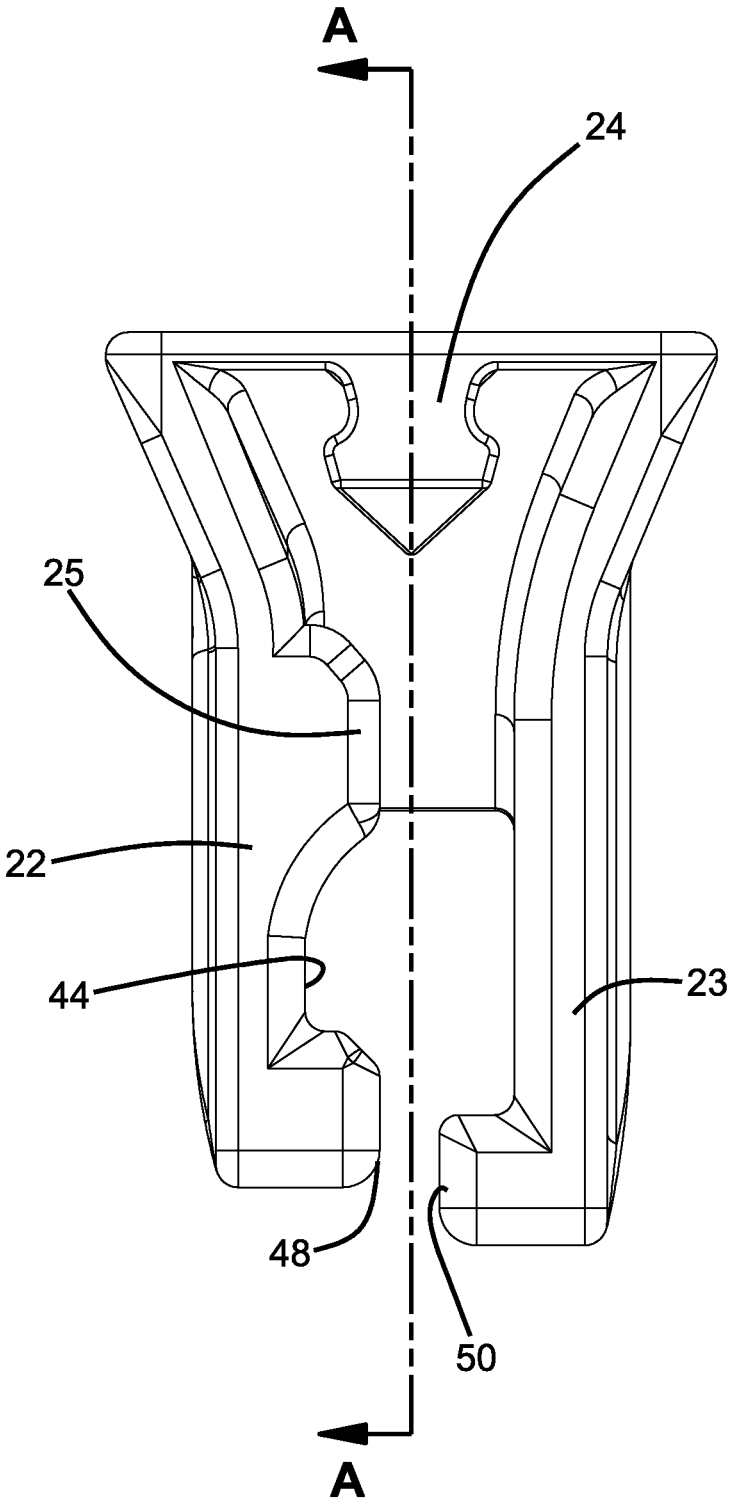
FIG. 3 is an end view of the slider of FIG. 2.

The slider 1 further includes a top member 21 (FIG. 3). A pair of spaced legs 22, 23 (FIG. 3) depends from the top member 21. The spaced legs 22, 23 define an open volume 44 (FIG. 3) therebetween to allow for passage of the tracks 31, 32 therethrough with the legs 22, 23 straddling the tracks 31, 32. The slider 1 further includes internal surfaces 46 (FIG. 4) that are spaced sufficiently close together in a vicinity of the closing end 36 to press the profiles 5 into interlocking relationship as the slider 1 is moved in a closing direction 38 (FIG. 6) along the zipper closure 7. The internal surfaces 46 can be part of the internal surfaces of the legs 22, 23, and they also may include a portion of the top member 21.

The spaced legs 22, 23 can be a variety of shapes. In the example shown in FIGS. 2 and 3, each of the spaced legs 22, 23 has a hook 48, 50 directed toward the internal volume 44 at a free end of each of the legs 22, 23. The hooks 48, 50 engage an external portion of the zipper closure 7 to retain the slider 1 in operative position on the zipper closure 7. In one example embodiment, the hooks, 48, 50 can engage lower shoulders 52, 54 (FIG. 13) of the zipper closure 7 to retain the slider 1 on the zipper closure 7.

The slider 1 further includes a separator plow 24. The separator plow 24, in this embodiment, extends from the opening end 34. It can extend from the legs 22, 23 or from the top member 21. In the example embodiment shown, the plow 24 extends from the top member 21. The separator plow 24 is selectively movable into a position to be between the interlocking member 31 and interlocking member 32 and separate the interlocking profiles 5 as the slider 1 is moved in the opening direction 39 along the zipper closure 7. Positioning of the plow 24 between the tracks 31, 32 can be done by rocking or pivoting the opening end 34 of the slider 1 in a direction toward the profiles 5.

Figure 4:
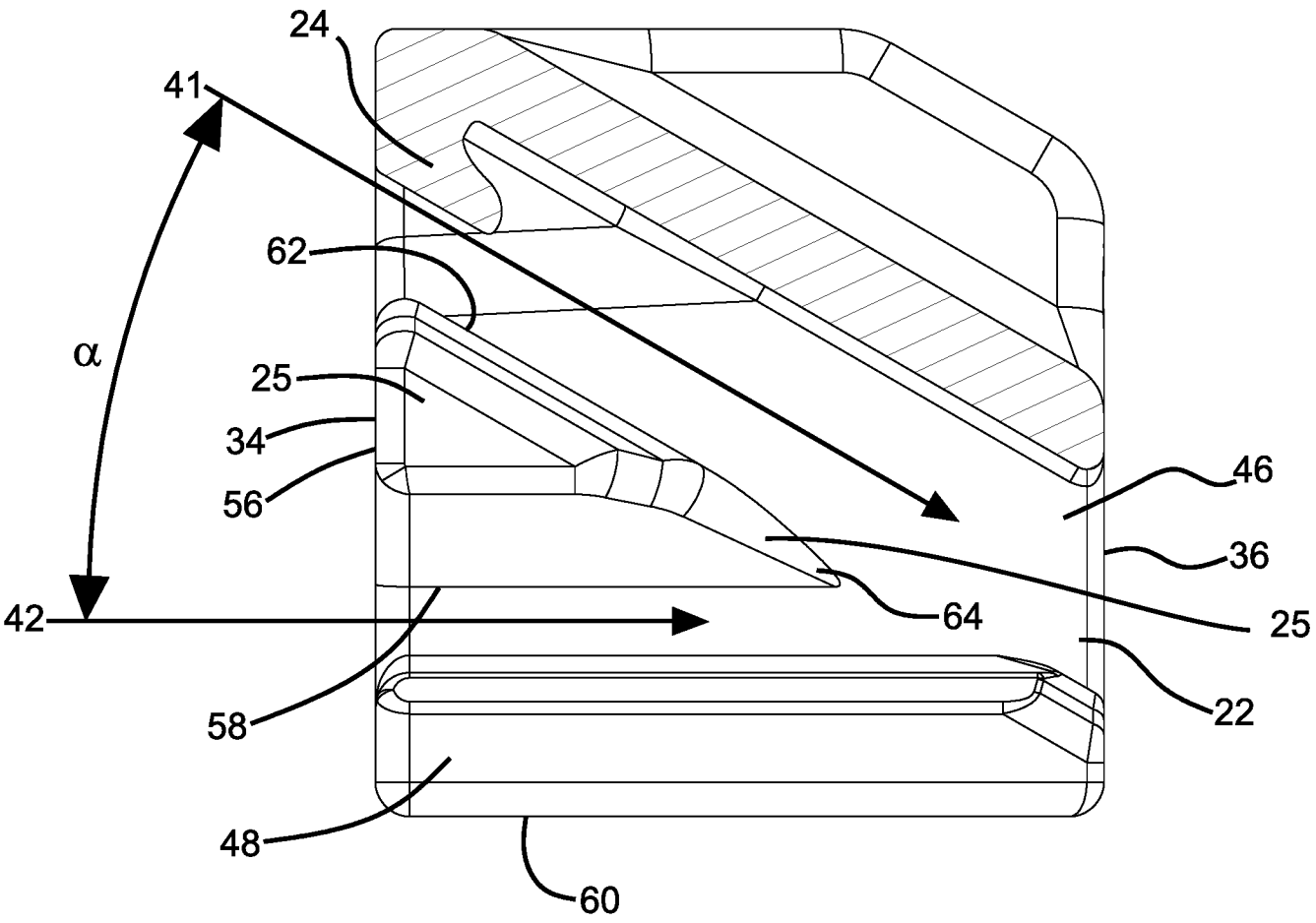
FIG. 4 is a cross-sectional view of the slider of FIGS. 2 and 3, the cross-section being taken along the line A-A of FIG. 3.

Attention is directed to FIGS. 2-4. In accordance with principles of this disclosure, the slider 1 further includes a protrusion 25. In the embodiment shown, protrusion 25 extends from at least one of the legs 22, 23 into the open volume 44 toward the opposite leg 22, 23. In the example shown, the protrusion 25 extends from the leg 22 into the open volume 44 toward the leg 23. The protrusion 25 can be many different shapes. In general, the protrusion 25 is a bump that extends from leg 22 to leg 23, while allowing for sufficient room for the closure profile 5 to fit in between. The legs 22, 23 deflect away from each other to allow the profile 5 to fit between.

In the example shown in FIG. 4, the protrusion 25 has a triangle-shaped periphery. A base 56 of the triangle-shaped periphery of the protrusion 25 is even with the opening end 34 of the slider 1, although it can be in other locations in other embodiments. A first side 58 (FIG. 4) of the protrusion 25 is generally parallel with a bottom edge 60 of the slider 1. A second side 62 of the protrusion 25 extends at an angle downward from the opening end 34 in a direction toward the bottom edge 60 until joining with the first side 58 at an apex 64. The apex 64, in this example embodiment, is located at a point more than half of the overall length of the slider 1 between the opening 34 and closing end 36, but is short of extending to the closing end 36. In this embodiment, the apex 64 is between 50% and 75% of an overall length of the slider 1 between the opening end 34 and closing end 36. Many embodiments are possible.

It should be understood that while the protrusion 25 is shown on the leg 22, in other embodiments, the protrusion 25 may be provided on the leg 23 or in some cases, on both legs 22 and 23.

In accordance with principles of this disclosure, at least one of the legs 22, 23 has a first track-accommodating groove 41 and a second track-accommodating groove 42. In FIG. 4, the leg 22 defines the grooves 41, 42, which are open to the open volume 44 and facing the opposite leg 23. As can be seen in FIG. 4, the grooves 41 and 42 are separated by the protrusion 25. As will be apparent from the description below, the grooves 41, 42 are of a sufficient width to accommodate the closure profiles 5 within each. For example, when the slider 1 is in a position to separate the tracks 31, 32, the closure profiles 5 are slidably positioned in the first groove 41; and, when the slider 1 is disabled from being able to separate the tracks 31, 32, the closure profiles 5 are slidably positioned in the second groove 42.

The first track-accommodating groove 41 and second track-accommodating groove 42 are angled relative to each other at an angle $\alpha$. The angle $\alpha$ will be greater than 0° and less than 90°. In many examples, the angle $\alpha$ is between 10-60°, and in many embodiments, the angle $\alpha$ is between 20-40°. In the example embodiment shown, this is also the same angle between the second side 62 and first side 58 of the protrusion 25, but in other embodiments where the protrusion 25 is of other shapes, the angle between second 62 and first side 58 may be different.

C. Example Embodiment of Slider 200

A second embodiment of a child resistant slider is shown in FIGS. 15-23 at 200. The slider 200 has features similar to the slider 1. The common reference numerals for slider 200 used for slider 1 have the same descriptions, and are not repeated here. Rather, the following description of the embodiment of slider 200 will focus on the differences from the slider 1.

Slider 200 does not include protrusion 25 or track accommodating grooves 41, 42. Rather, in accordance with principles of this disclosure, slider 200 includes a spring tab 202. The spring tab 202 generally extends from the closing end 36 of the slider 200.

Figure 15:
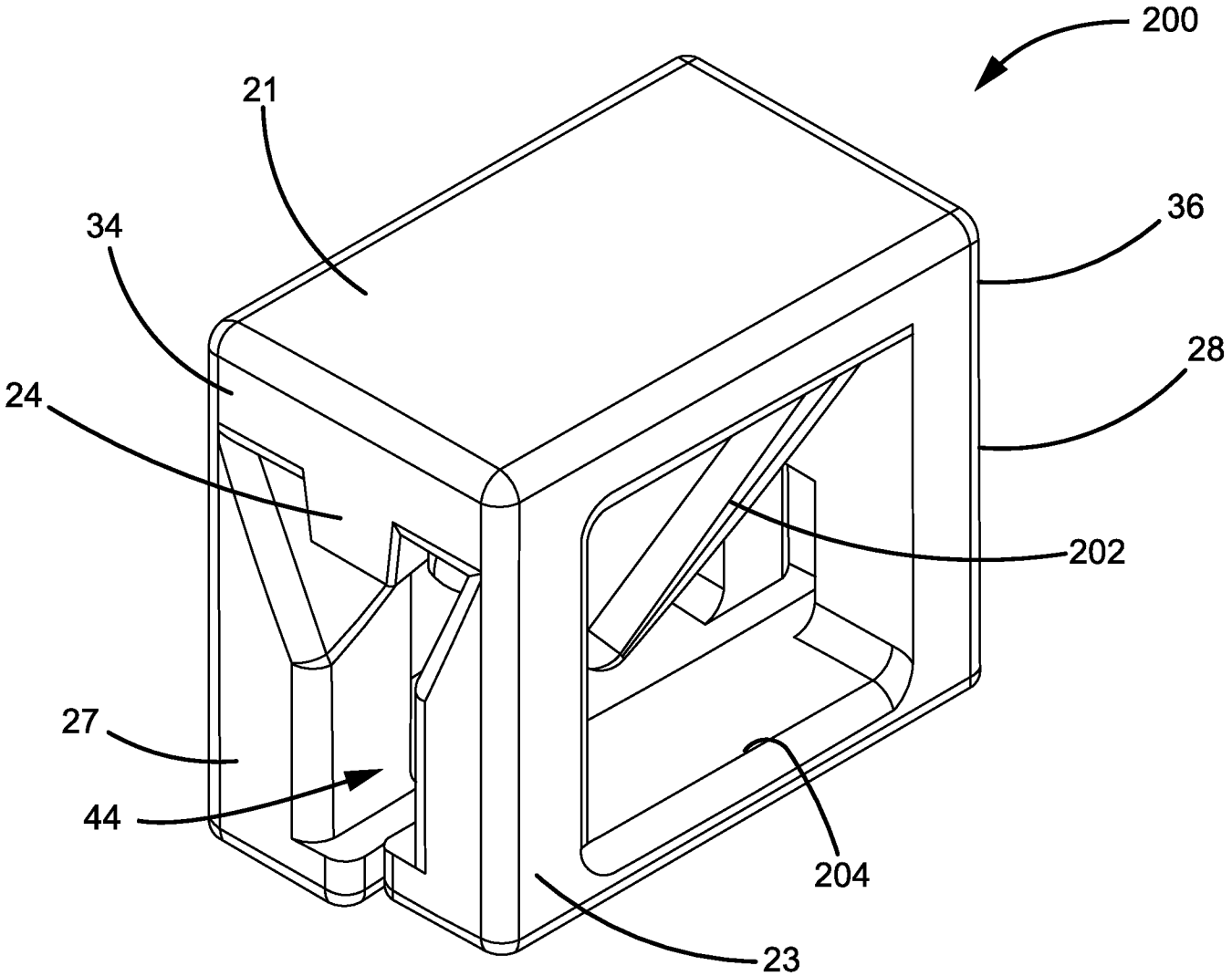
FIG. 15 is a perspective view of a second embodiment of a slider, usable with the zipper closure of FIG. 1, constructed in accordance with principles of this disclosure.
Figure 16:
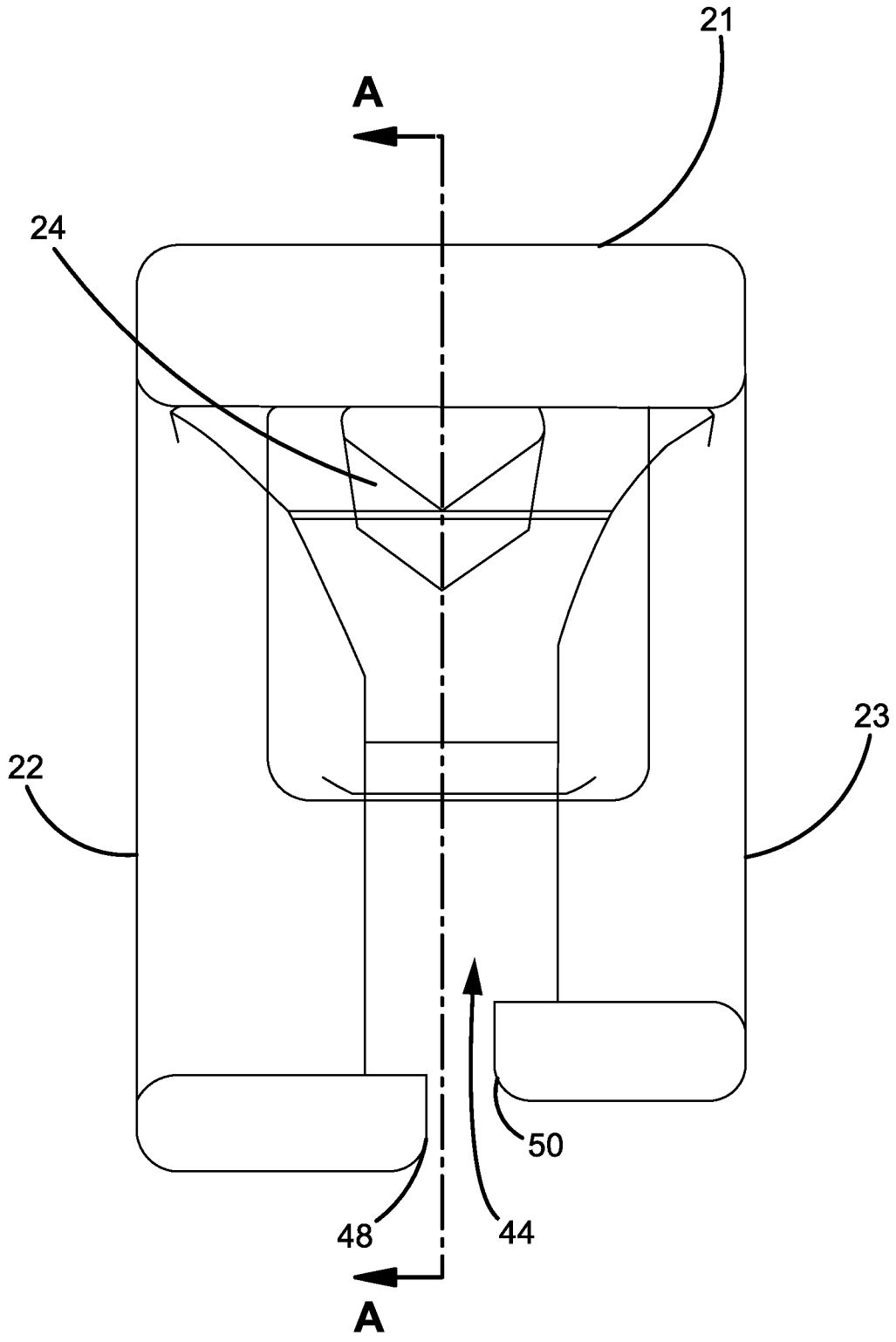
FIG. 16 is a left end view of the slider of FIG. 15.
Figure 17:
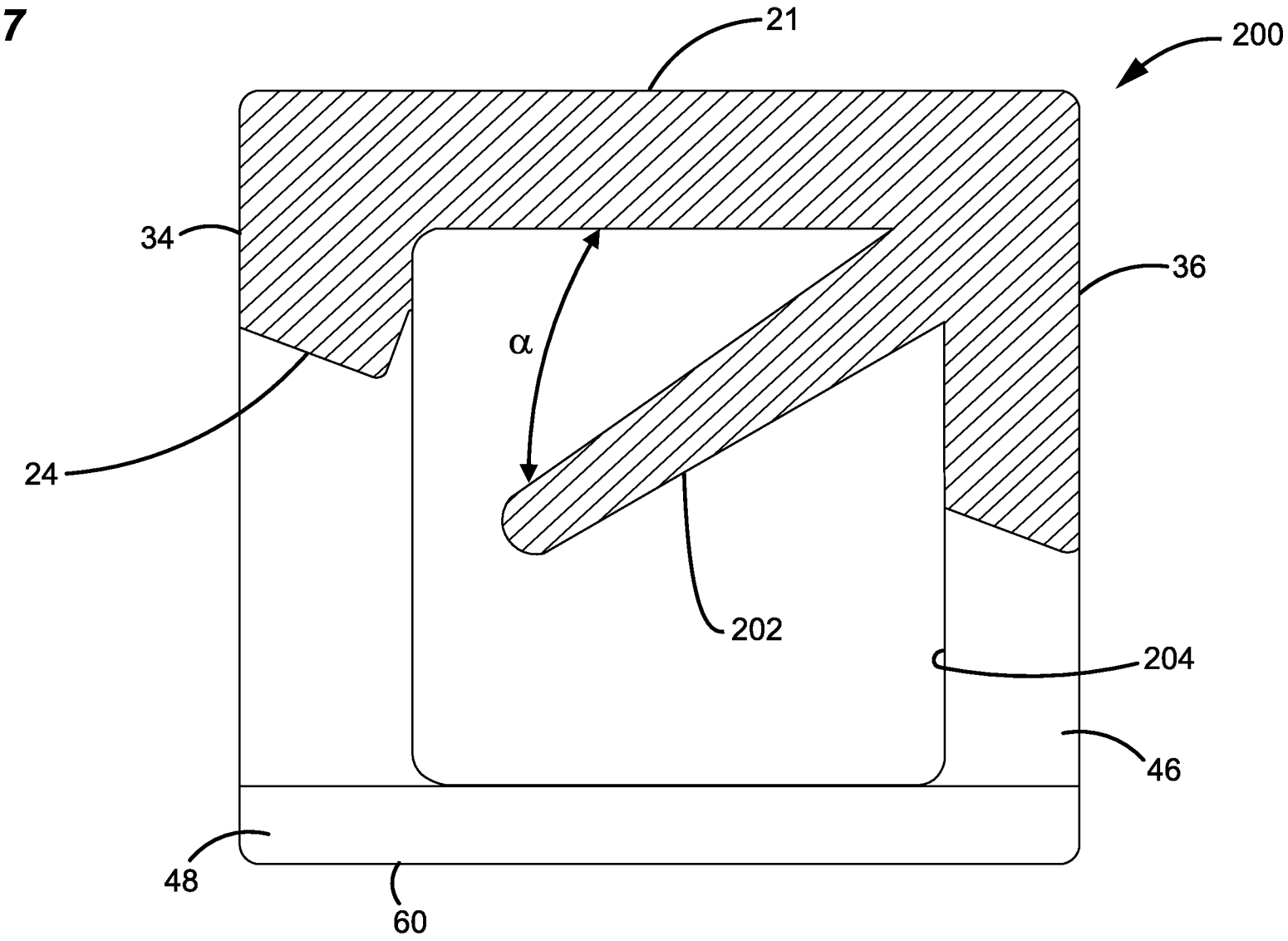
FIG. 17 is a cross-sectional view of the slider of FIGS. 15 and 16, the cross-section being taken along the line A-A of FIG. 16.

In the embodiment of FIGS. 15 and 17, the spring tab 202 is shown extending from the top member 21 and into the open volume 44 between the legs 22, 23. While this embodiment shows the spring tab 202 as extending from the top member 21, in other embodiments, the spring tab 202 could also extend from one of the legs 22, 23.

The spring tab 202 is illustrated as being angled from the top member 21 at an angle $\alpha$ (FIG. 17). The angle $\alpha$ can be in a range of at least 15°, no greater than 40°, and often 20-35°. The spring tab 202 is made from a material that allows elastic flexibility so that the tab 202 can be deflected or bent from its natural position (its natural position being the position shown in FIG. 17 angled at angle $\alpha$ from the top member 21) in a direction toward the top member 21 when under force; without force, the spring tab 202 returns to its natural, undeflected position shown in FIG. 17. Typically, the spring tab 202 is a molded plastic made from the same material as a remaining portion of the slider 200. In other embodiments, the spring tab 202 can be other materials or a different material from the rest of the slider 200, such as a spring metal.

The spring tab 202 has a length that extends in an axial direction along the legs 22, 23 and away from the top member 21. The length of the spring tab 202 as it extends in an axial direction along the legs 22, 23 is less than a full length of either of the legs 22, 23, and will typically be less than 75% of a length of the legs 22, 23. In many cases, the spring tab 202 will be less than 66% of the length of the legs 22, 23.

In this embodiment, the top member 21 is generally flat and planar. The separator plow 24 extends from the opening end 24 of the slider. In this embodiment, the separator plow 24 extends from the top member 21 into the open volume 44. In other embodiments, the separator plow 24 could extend from one of the legs 22, 23.

The legs 22, 23 each has an opening or window 204 to allow for a visible inspection of the internal components of the slider 200, including the spring tab 202 and the plow 24. Using the window 204, the user will be able to see the location of the plow 24 and the spring tab 202.

The use of the slider 200 with an example closure system is described further below.

D. Example Closure System

Figure 5:
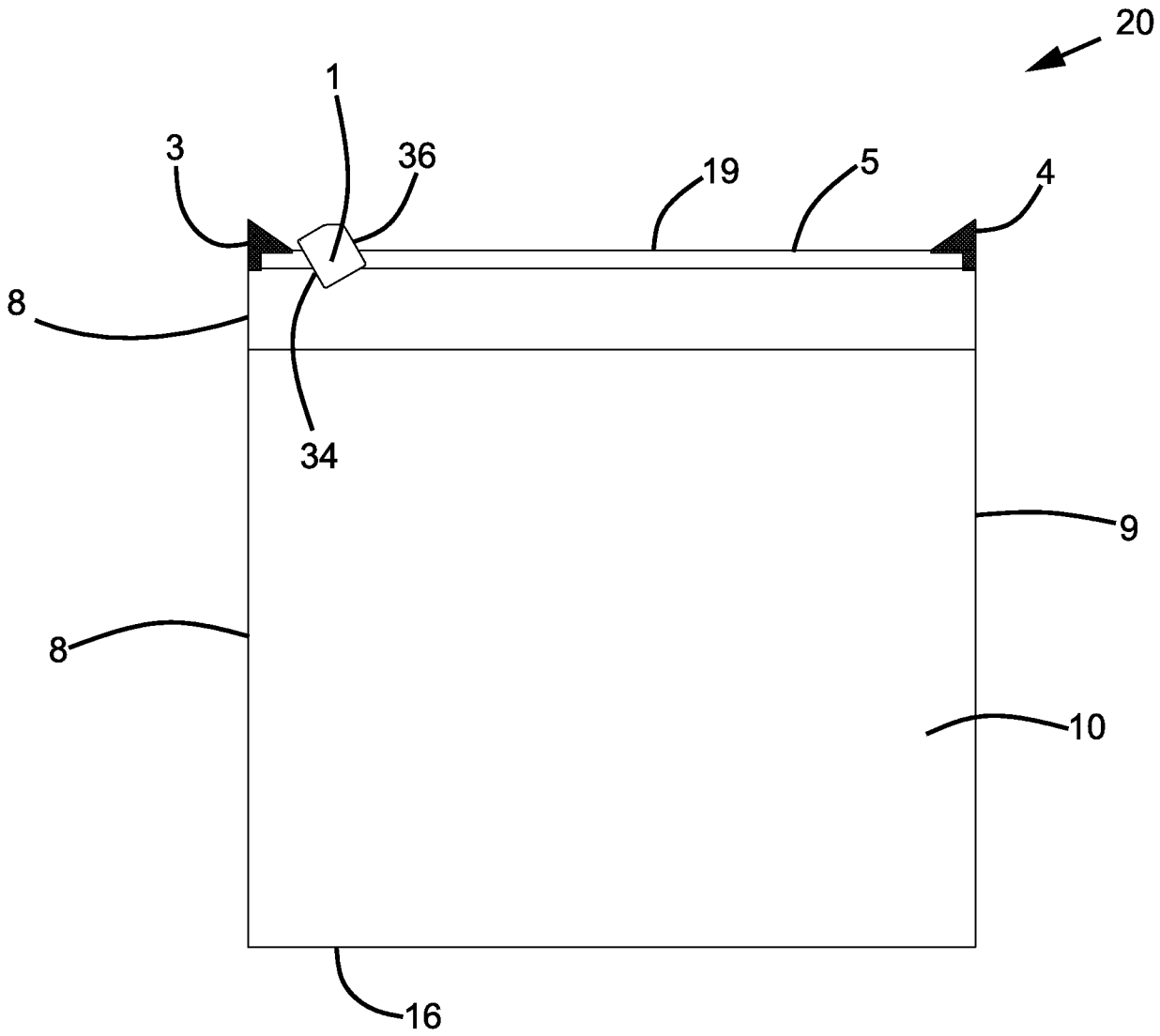
FIG. 5 is a front view of the flexible package of FIG. 1 and showing the slider in a position engaged with a plow between the tracks to allow the slider to open the closure.

The slider 1, as described above, is usable with the zipper closure 7 and package 20, described previously. The slider 1 is slidably located on the zipper closure 7, with the legs 22, 23 straddling the closure profiles 5 including the interlocking member 31 and interlocking member 32. In FIG. 1, the slider 1 is located on the zipper closure 7 in a position in which the slider 1 is disabled from being able to open the zipper closure 7. In FIG. 5, the slider 1 is located in an operative position to allow the slider 1 to separate the interlocking member 31 and interlocking member 32 to open the zipper 7.

In particular, in FIG. 1, the plow 24 of the slider 1 is outside of a position between the tracks 31, 32; while in FIG. 5, the plow 24 is in a position between the interlocking member 31 and interlocking member 32. The slider 1 is rockable or pivotable between the position of FIG. 1 and the position of FIG. 5, with the protrusion 25 having to be overcome to go between these two positions.

Many embodiments are possible, and in the configuration shown, the separator plow 24 can be positioned between the interlocking member 31 and interlocking member 32 to put the slider 1 in an operative position to be able to open the mouth 18 by pivoting the opening end 34 of the slider 1 in a direction toward the notch 2 and downwardly in a direction toward the bottom edge 16 of the package 20. Positioning the slider 1 in the operative position to be able to separate the closure profiles 5 moves the closure profiles 5 from the second groove 42 to the first groove 41.

To position the separator plow 24 in a position outside of the interlocking member 31 and interlocking member 32 to prevent separation of the tracks 31, 32, the slider 1 is rocked or pivoted to move the opening end 34 of the slider 1 in a direction away from the notch 2 and away from the bottom edge 16 of the package 20 and outside of the tracks 31, 32 to return the slider 1 to a position as shown in FIG. 1, with the bottom edge 60 of the slider 1 generally parallel to the closure profiles 5. In this position, the slider 1 is disabled and cannot separate the closure profiles 5. Positioning the slider 1 in this disabled position moves the closure profiles 5 from the first groove 41 to the second groove 42.

When the slider 1 is pivoted to move the separator plow 24 into or out of a position between the interlocking member 31 and interlocking member 32, the protrusion 25 will engage against an external portion of the closure profile 5 to provide a tactile indication of a changed position of the separator plow 24. This tactile indication, arising from outward flexing and returning of legs 22, 23, gives the user a sign when the plow 24 has been moved to an opening position from an unopening (disabled) position, and from an unopening (disabled) position to an opening position.

Figure 14:
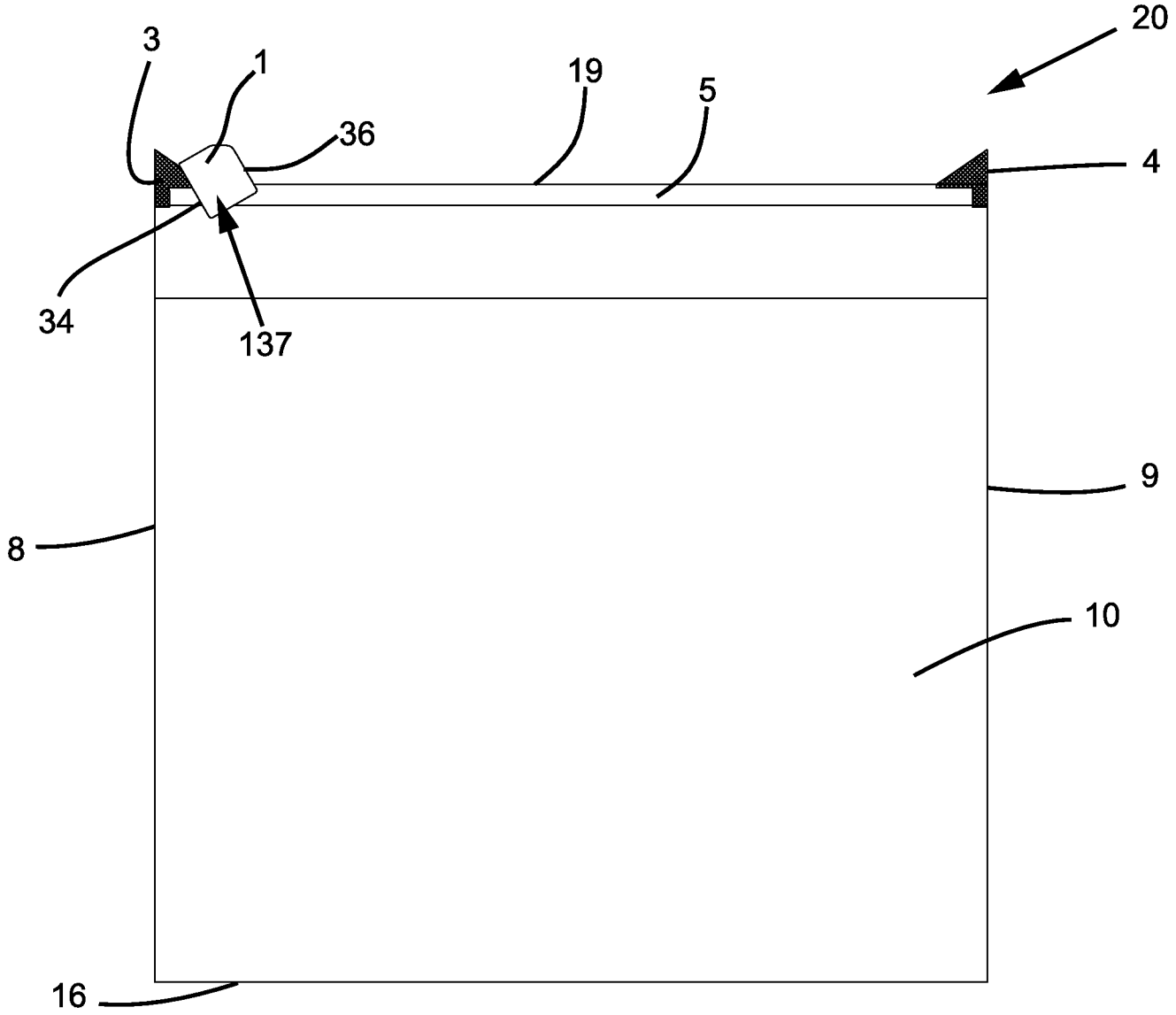
FIG. 14 is the flexible package of FIG. 1 showing the slider in an engaged position for opening the closure.

When the slider 1 is in the disabled position so that the plow 24 is not between the interlocking member 31 and interlocking member 32, the closure profiles 5 are accommodated within the second groove 42, to allow the profile 5 to slide within the groove 42 without having the plow 24 between the male and female tracks 31, 32 of the closure profiles 5. In the disabled position, the slider 1 can close the mouth 18, or maintain closure of the mouth 18, but cannot separate the closure profiles 5 to open the mouth 18. FIG. 14 illustrates a step of disengaging use of the slider 1 by using the end stop 3 to guide the slider 1 in a pivoted motion to pivot the opening end 34 away from the notch 2 and move the plow 24 from between the interlocking member 31 and interlocking member 32. This is done by directly contacting the opening end 34 of the slider 1 against the end stop 3 and sliding the slider 1 relative to the end stop 3.

When the slider 1 is in an opening (operative) position (FIG. 5) the plow 24 is moved between the interlocking member 31 and interlocking member 32, and the male and female tracks 31, 32 slide within the first groove 41 of the slider 1. When in the opening/operative position, the slider 1 can open the mouth 18 as the slider 1 is moved in the opening direction 39 (FIG. 6) by separating the interlocked tracks 31, 32, and the slider 1 can close the mouth 18 by interlocking the tracks 31, 32 as the slider 1 is moved along the zipper closure 7 in the closing direction 38 (FIG. 6).

For the embodiment of FIGS. 1-7, to operate the zippered package 20, the slider 1 is moved to the notch 2, and the slider 1 is locked by pivoting the opening end 34 toward the notch 2 to position the separator plow 24 between the interlocking member 31 and interlocking member 32. The slider 1 is then moved in the opening direction 39 along the zipper closure 7 with the plow 24 positioned between the interlocking member 31 and 32 to result in separation of the closure profiles 5. The mouth 18 is closed by moving the slider 1 in a direction opposite of the opening direction in the closing direction 38 toward the notch 2 and along the zipper closure 7.

The slider 1 can be disabled from being able to open the mouth 18 by moving the slider 1 to the notch 2 and pivoting the slider 1 to move the opening end 34 away from the notch 2 and move the plow 24 from between the interlocking member 31 and interlocking member 32.

In the embodiment of FIGS. 8-11, the flexible package 120 is depicted with closure 107. In this embodiment, the opposite ends of the closure 107 include end stops in the form of flexible clips 103, 104, as previously described.

The slider 101 is constructed in the same way as slider 1; however, in other embodiments, it may have an internal construction that is different from slider 1 to adapt to the different end stops 103, 104.

Figure 10:
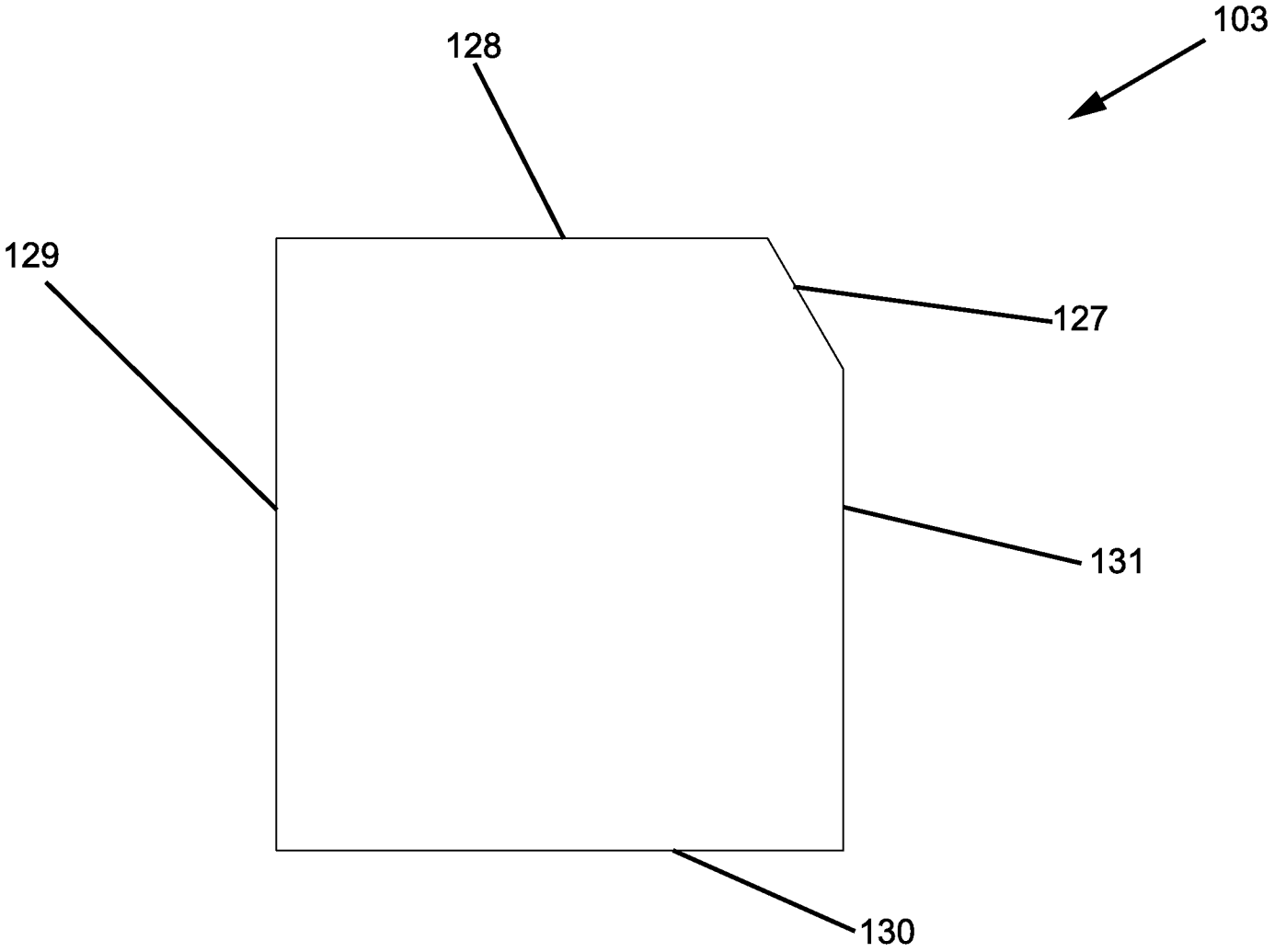
FIG. 10 is a front view of one of the end clips used for the flexible package of FIGS. 8 and 9.

FIG. 10 is an enlarged view of the end clip 103, which is the clip closest to the notch 2. The end clip 103 has a top end 128, outside edge 129, bottom edge 130, and inside edge 131. The outside edge 129 is the edge generally even with the side edge 8 of the package 120 (although it is not necessary to be even with the side edge 8), while the inside edge 131 is the edge facing the rest of the zipper closure 107. Extending between the top edge 128 and the inside edge 131 is a chamfer or angled surface 127. The angled surface 127 extends in a direction downwardly from the top end 128 and in a direction toward the closure profiles 5 in a general direction toward the opposite side edge 9 of the package 120. The angled surface 127 assists the user in positioning the slider 101 to move in an upward direction away from the closure profiles 5 in order to disengage from the zipper closure 107.

Figure 8:
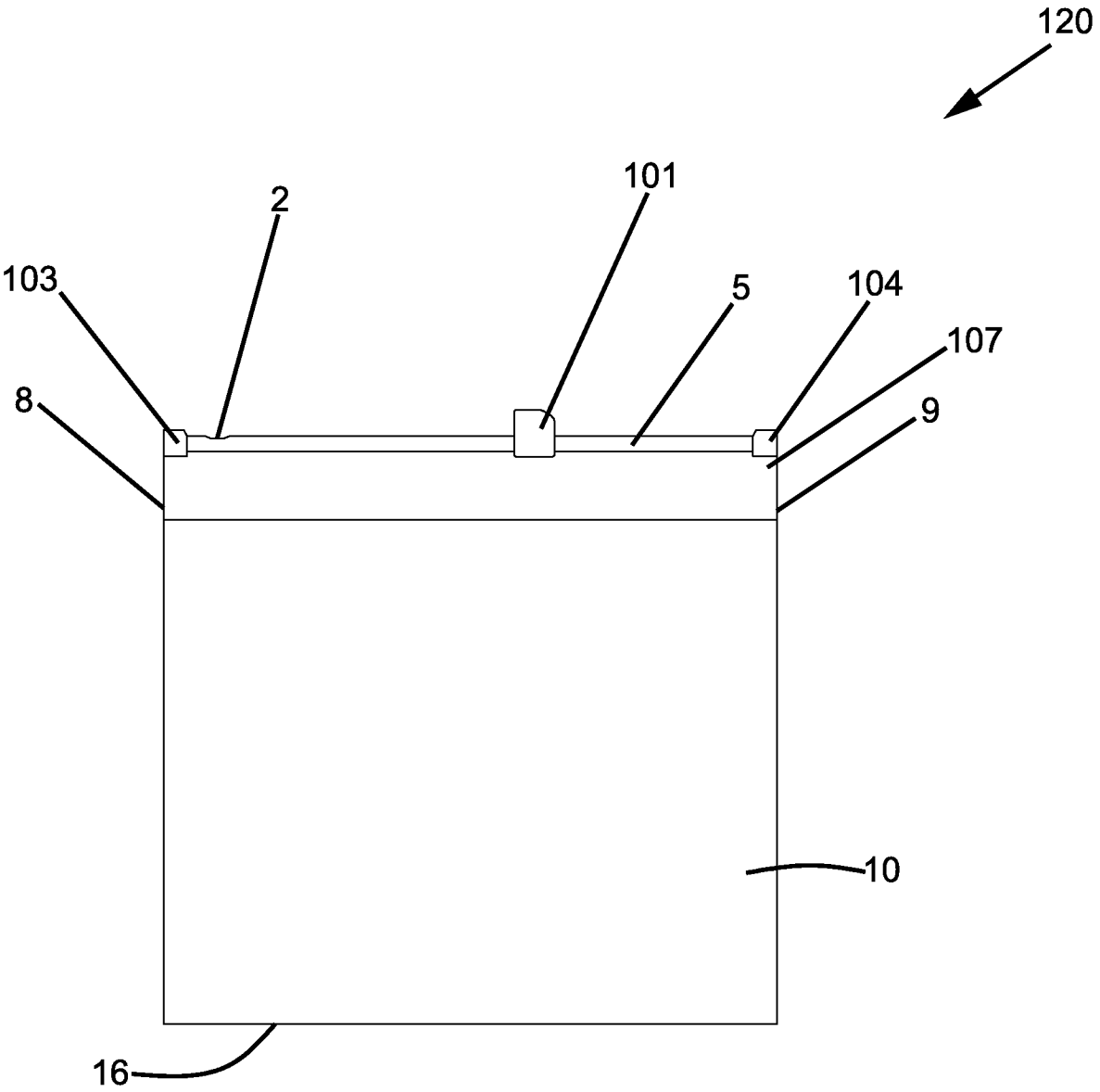
FIG. 8 is a front view of a flexible package and a second embodiment of a zipper closure system having a slider.
Figure 9:
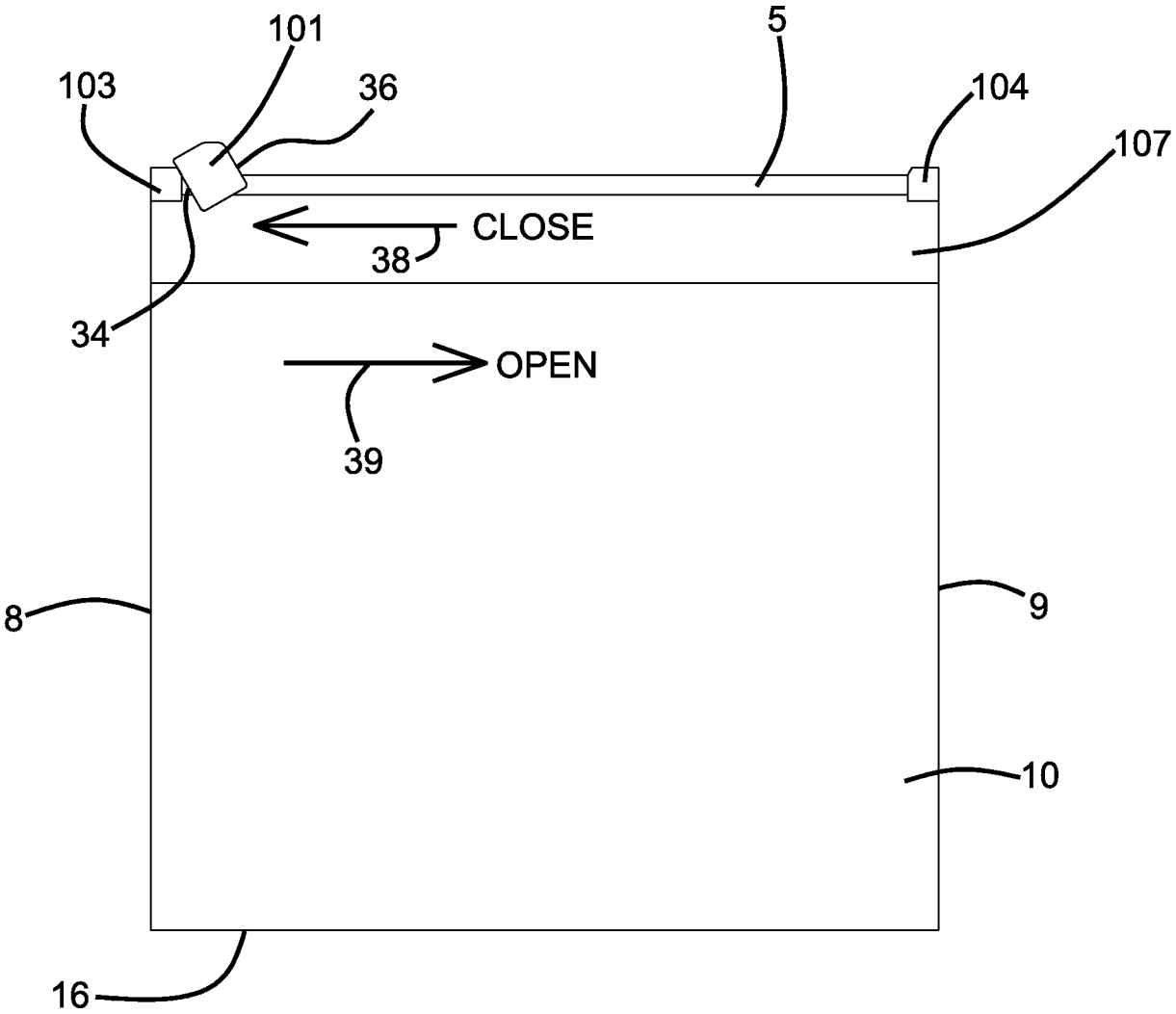
FIG. 9 is the flexible package of FIG. 8 showing the slider in an engaged position for opening the closure.

FIG. 8 shows the slider 101 in a position disengaged from being able to open the closure 107. In FIG. 9, the slider 101 is shown in the engaged position, with the opening end 34 of the slider 101 pivoted toward the notch 2. In the position of FIG. 9, the plow 24 is between the interlocking member 31 and interlocking member 32. When moved in the opening direction 39, the slider 101 in the engaged position of FIG. 9 will separate the interlocking member 31 from the interlocking member 32.

Figure 11:
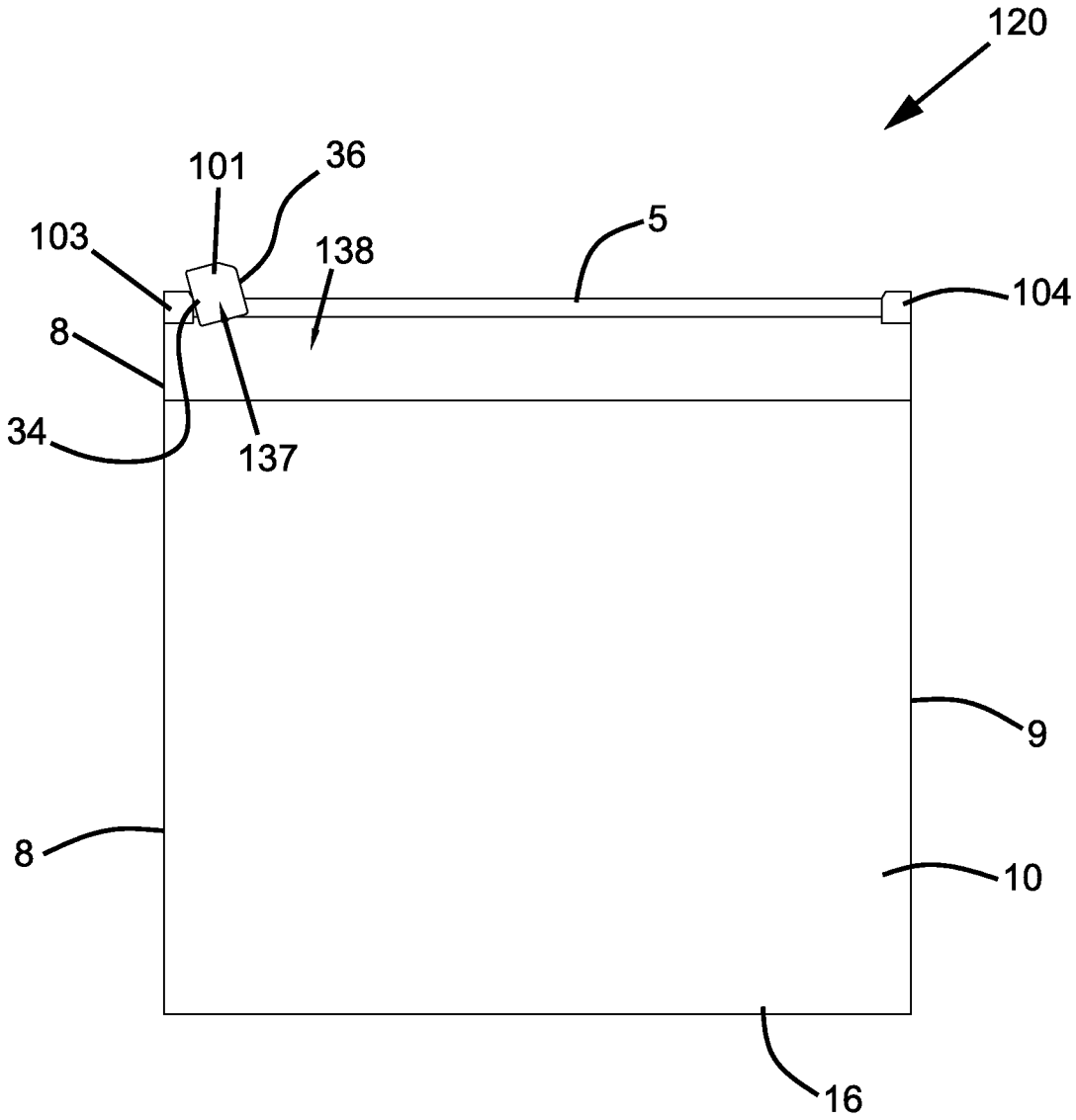
FIG. 11 is a front view of the flexible package of FIGS. 8 and 9 and showing the slider in contact with the end clip of FIG. 10.

In FIG. 11, the slider 101 is engaged against the end clip 103 and is being moved to disengage the slider 101 from being able to open the closure 107. The slider 101 is moved in an upward direction 137 while the opening end 34 of the slider 101 is pressed against the angled surface 127 of the end clip 103.

Figure 12:
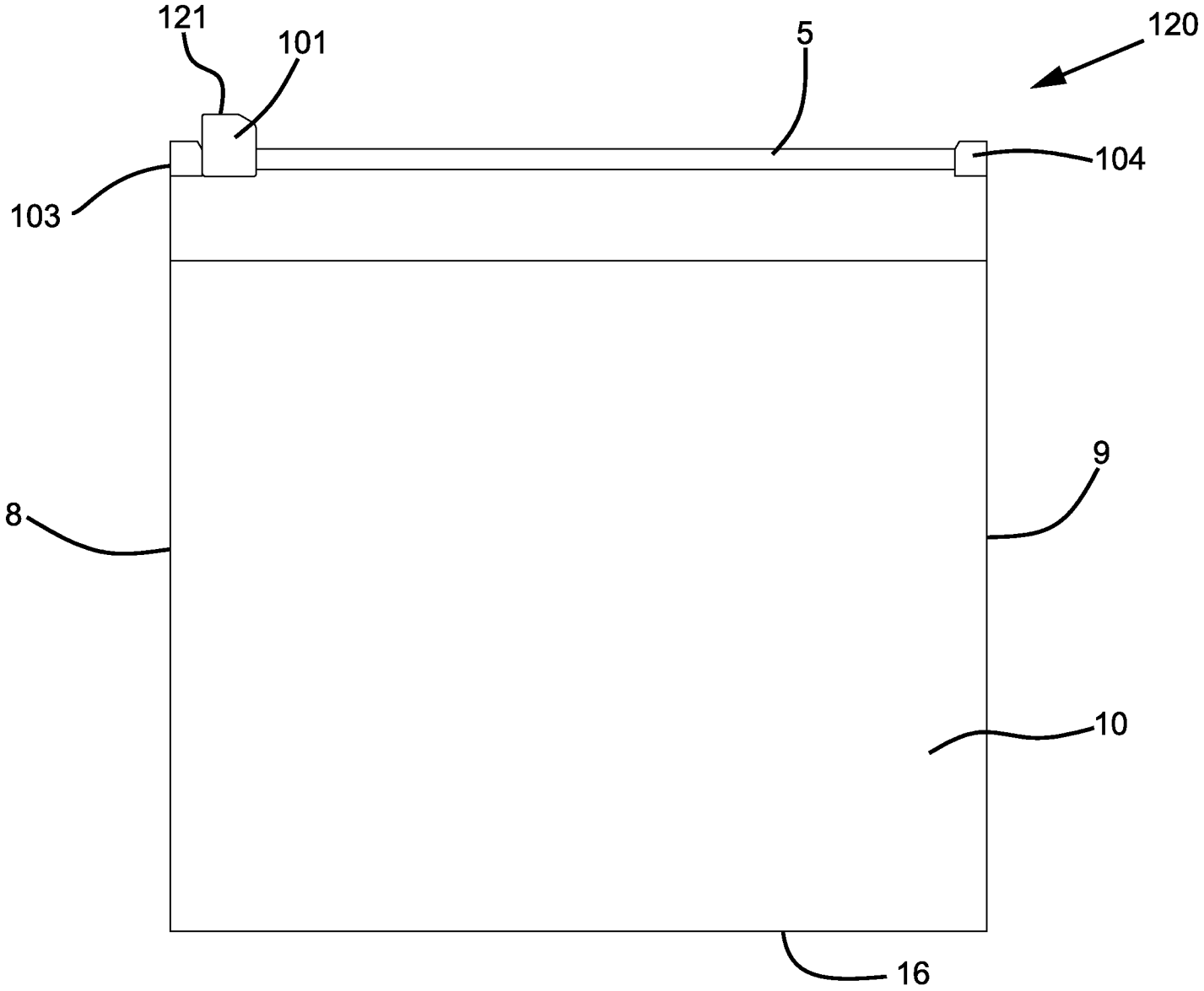
FIG. 12 is a front view of the flexible package of FIGS. 8, 9, and 11 and showing the slider in a disengaged or disabled position.

In FIG. 12, the slider 101 has completed the pivoting motion and has reached the disengaged position. In this position, in the particular example shown in the drawings, the top member 121 of the slider 101 is horizontal, when the zipper closure 107 is along a plane that is also horizontal. Other embodiments for the slider 101 are possible in which the top member 121 will not necessarily be horizontal in this position. The slider 101 cannot open the closure 5 when sliding in the opening direction 39 or closing direction 38 unless it is first lined up with the notch 2 and rocked with the opening end 34 downwardly (FIG. 9) to re-engage the profile 5 by inserting the plow 24 between the interlocking member 31 and interlocking member 32 to reopen the closure 107.

Figure 18:
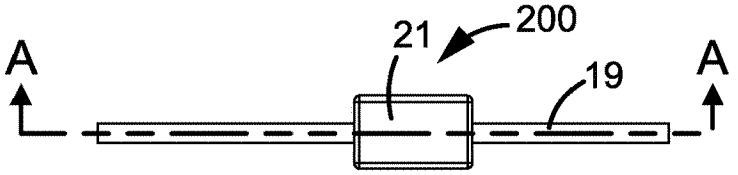
FIG. 18 is a top view of the slider of FIG. 15 positioned on the flexible package of FIG. 1.
Figure 21:
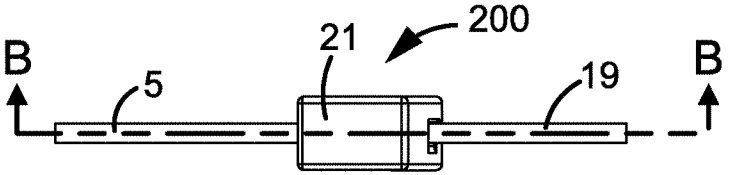
FIG. 21 is a top view of the flexible package and slider of FIG. 18, but showing the slider in an engaged position for opening the closure.
Figure 19:
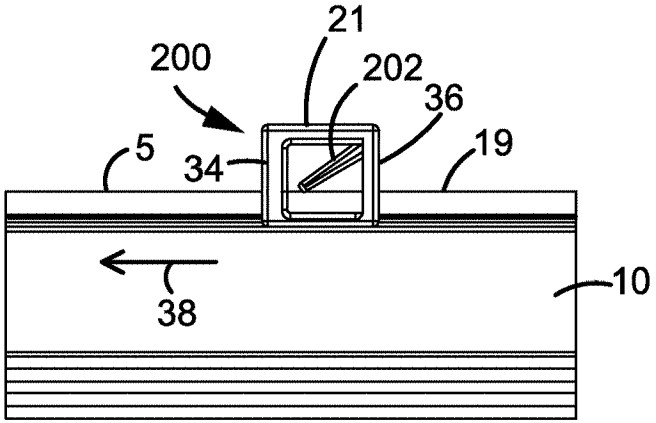
FIG. 19 is a front view of the flexible package of FIG. 18 and showing the slider in a disengaged or disabled position.
Figure 22:
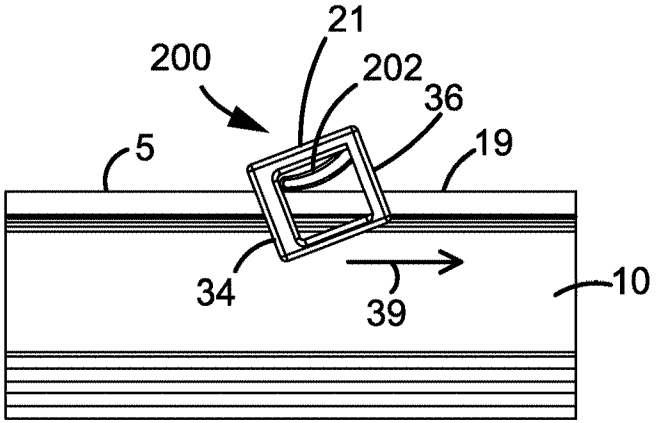
FIG. 22 is a front view of the flexible package and slider of FIG. 21 with the slider in the engaged position.
Figure 20:
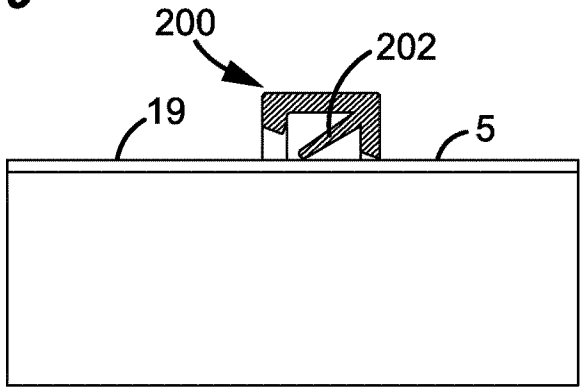
FIG. 20 is a cross-sectional view of the flexible package and slider of FIGS. 18 and 19, the cross-section being taken along the line A-A of FIG. 18.
Figure 23:
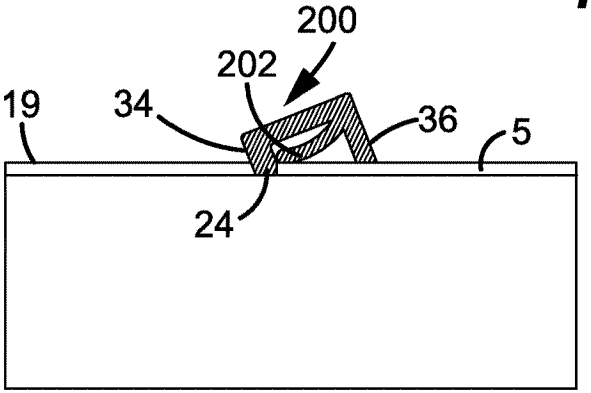
FIG. 23 is a cross-sectional view of the flexible package and slider of FIGS. 21 and 22, the cross section being taken along the line B-B of FIG. 21.

The slider 200, as described above, is usable with the zipper closure 7 and package 20, described previously. In FIGS. 18-20, the slider 200 is located on the zipper closure 7 in a position in which the slider 200 is disabled from being able to open zipper closure 7. In FIGS. 21-23, the slider 200 is located in an engaged or operative position to allow the slider 200 to separate the interlocking members 31 and 32 to open the zipper 7.

In FIGS. 18-20, the plow 24 of the slider 200 is outside of a position between the tracks 31, 32; while in FIGS. 21-23, the plow 24 is in a position between the interlocking member 31 and interlocking member 32. The spring tab 202 is engaged against a top of at least one, and in some cases both, of the closure profiles 5. In FIGS. 21-23, the spring tab 202 can be seen in its deflected position engaged against the closure profile 5.

In FIGS. 18-20, the slider 200 is positioned with the plow 24 outside of the interlocking members 31, 32 and can be used to close the zipper closure 7 by moving the slider 200 in the closing direction 38 (FIG. 19). In FIG. 22, the slider 200 is in the engaged position with the plow 24 between the interlocking members 31, 32 and can be moved in the opening direction 39 to disengage the interlocking members 31, 32 to open the zipper 7.

The slider 200 is moved from the disabled or disengaged position of FIGS. 18-20 to the engaged or operative position of FIGS. 21-23 by rocking or pivoting the slider 200 so that the plow 24 is moved between the interlocking members 31, 32. In the embodiment shown of FIGS. 18-23, the top member 21 is pivoted from a position being generally parallel to the zipper closure 7 to a position that is angled so that the opening end 34 is positioned closer to the zipper closure 7 than the closing end 36. In this manor, the top member 21 is angled at a non-zero angle as it extends from the opening end 34 to the closing end 36. This non-zero angle can be at least 5°, no greater than 90°, and typically 15-30°.

When the slider 200 is pivoted to selectively move the separator plow 24 into the position between the interlocking members 31, 32, the spring tab 202 engages against a top of at least one of the profiles 5 so that the user must apply a continuous force on the slider 200 to overcome a force of the spring tab 202 to keep the plow 24 between the interlocking members 31, 32. If the user does not apply a continuous force to keep the plow 24 in the engaged position between the interlocking members 31, 32, the spring tab 202 will push the slider 200 to the position of FIGS. 18-20 and move the plow 24 out of engagement between the members 31, 32.

E. Example Methods

A method of operating a zippered bag, such as package 20, 120 includes providing the bag 20, 120 having recloseable zipper closure 7, 107 with interlocking member 31 and interlocking member 32 for interlocking and unlocking. The closure 7, 107 includes notch 2 spaced a distance from a first side 8. The slider 1, 101, 200 is located on the zipper closure 7, 107. The mouth 18 of the closure 7, 107 can be opened by moving the slider 1, 101, 200 to the notch 2.

Next, there is a step of rocking or pivoting the slider 1, 101, 200 so that the opening end 34 of the slider 1, 101, 200 is moved toward the notch 2 to position the separator plow 24 extending from the top member 21, 121 between the interlocking member 31 and interlocking member 32.

While the plow 24 is between the male 31 and interlocking member 32, there is a step of moving the slider 1, 101, 200 in an opening direction 39 along the zipper closure 7, 107 to result in separation of the interlocking profiles 31, 32.

The step of pivoting the slider 1, 101 includes moving the protrusion 25 over an external portion of the closure profile 5 to receive a tactile indication that the plow 24 has been moved to a position between the interlocking member 31 and interlocking member 32. The tactile indication is from feeling the outward flexing and returning of legs 22, 23. This step can also include moving the slider 1, 101 to re-position the closure profiles 5 from the second groove 42 to the first groove 41.

The method further includes a step of closing the mouth 18 by moving the slider 1, 101, 200 in a closing direction 38 toward the notch 2 along the zipper closure 7, 107. This step includes the internal surfaces 46 of the slider 1, 101 pressing against the outside walls of the zipper closure 7, 107 to press the interlocking member 31 and interlocking member 32 together in an interlocking engagement.

The method further includes a step of disabling the slider 1, 101, 200 from being able to open the mouth by moving the slider 1, 101, 200 to the notch 2 and rocking or pivoting the slider 1, 101 to move the opening end 34 in a direction 137 upward and away from the notch 2, while moving the closing end 36 of the slider 1, 101 in a direction toward the closure profiles 5.

The step of disabling the slider 1, 101, 200 can include engaging the opening end 34 of the slider 1, 101, 200 against an end stop 3 or end clip 103 positioned at the end of the zipper closure 7, 107. The end stop 3, or end clip 103 can be used to guide the slider 1, 101, 200 in a pivoted motion to pivot the opening end 34 away from the notch 2 and move the plow 24 from between the interlocking member 31 and interlocking member 32.

The method may include using the slider 200 having spring tab 202 extending from the closing end 36. The spring tab 202 will exert a force against a top of at least one of the profiles 5. The step of moving the slider 200 in the opening direction along the zipper closure 7, 107 includes applying a continuous force on the slider 200 to overcome the force the spring tab 202 exerts against the top of at least one of the profiles 5 to keep the plow 24 between the interlocking members 31, 32.

The above represents example principles. Many embodiments can be made using these principles.

What is claimed is:

1. A slider for a zipper closure having interlocking members with complementary profiles for interlocking and unlocking; the slider comprising:

(a) an opposite opening end and closing end;

(b) a top member;

(c) a pair of spaced legs depending from the top member; the spaced legs defining an open volume therebetween to allow for passage of the tracks therethrough and with the legs straddling the tracks;

(d) internal surfaces spaced sufficiently close together in a vicinity of the closing end to press the profiles into interlocking relationship as the slider is moved in a closing direction along the zipper closure;

(e) a separator plow extending from the opening end; the separator plow being selectively moveable into a position to be between the interlocking members and separate the interlocking profiles as the slider is moved in an opening direction along the zipper closure by pivoting the opening end of the slider in a direction toward the profiles;

(f) a protrusion in the vicinity of the opening end extending from at least one of the legs into the open volume toward the opposite leg; and (g) wherein at least one leg has a first track-accommodating groove and a second track-accommodating groove; the first and second track-accommodating grooves being separated by the protrusion.

2. The slider of claim 1 wherein the first track-accommodating groove and second track-accommodating groove are angled relative to each other at an angle greater than 0° and less than 90°.

3. The slider of claim 1 wherein the first track-accommodating groove and second track-accommodating groove are angled relative to each other at an angle of 10-60°.

4. The slider of claim 1 wherein the first track-accommodating groove and second track-accommodating groove are angled relative to each other at an angle of 20-40°.

5. The slider of claim 1 wherein the protrusion has a triangle-shaped periphery.

6. The slider of claim 1 wherein the internal surfaces comprise internal surfaces of the legs, and the separator plow extends from the top member into the open volume between the legs.

7. The slider of claim 6 wherein each of the spaced legs has a hook at a free end to engage an external portion of the zipper closure to retain the slider in operative position on the zipper closure.

8. The slider of claim 7 wherein the protrusion extends from at least one of the legs.

9. The slider of claim 1 wherein the slider is molded as a single piece.

10. A child resistant slider zipper closure system comprising:

(a) a reclosable zipper closure with complementary profiles for interlocking and unlocking;

(b) a notch located in the zipper closure; and (c) a slider being slidably located on the zipper closure, the slider including spaced legs defining an open volume therebetween to allow for passage of the profiles therethrough; the slider including a separator plow, and the slider being pivotable relative to the zipper closure to selectively move the separator plow into or out of a position between the complementary profiles;

(i) the separator plow being positionable between the complementary profiles to separate them and open the zipper closure by pivoting the slider in a direction toward the notch; and (ii) the separator plow being positionable outside of the complementary profile to prevent their separation by pivoting the slider in a direction away from the notch and outside of the complementary profiles; and (d) a pair of end stops at opposite ends of the zipper closure.

11. The slider zipper closure system of claim 10 wherein the slider further includes a protrusion extending from at least one of the legs into the open volume toward the opposite leg; wherein when the slider is pivoted to selectively move the separator plow into or out of a position between the complementary profiles, the protrusion engages against an external portion of the zipper closure to provide a tactile indication of a changed position of the separator plow.

12. The slider zipper closure system of claim 11 wherein the at least one leg of the slider has a first track-accommodating groove and a second track-accommodating groove; the first and second track-accommodating grooves being separated by the protrusion.

13. The slider zipper closure system of claim 12 wherein the first track-accommodating groove and second track-accommodating groove are angled relative to each other at a first angle greater than 0° and less than 90°.

14. The zipper closure system of claim 10 wherein the end stops comprise ultrasonically welded terminations.

15. The zipper closure system of claim 10 wherein the end stops comprise flexible clips.

16. The zipper closure system of claim 10 wherein a first of the end stops in the vicinity of the notch has an angled surface extending at a non-zero and non-perpendicular angle from a top of the first end stop in a direction toward the notch.

17. The zipper closure system of claim 16 wherein the slider includes a top member, and the separator plow extends from the top member into the open volume between the legs.

18. The zipper closure system of claim 17 wherein:

(a) the slider further includes a spring tab extending therefrom and being between the spaced legs; wherein when the slider is pivoted to selectively move the separator plow into a position between the complementary profiles, the spring tab engages against a top of at least one of the profiles so that a user must apply a continuous force on the slider to overcome a force of the spring tab to keep the plow between the complementary profiles.

19. A method of operating a zippered bag having an openable and recloseable mouth; the method comprising:

(a) providing a zippered bag with a recloseable zipper closure including interlocking members with complementary profiles for interlocking and unlocking; the zipper closure including a notch spaced a distance from a first side of the zippered bag; a slider located on the zipper closure; the slider having an opening end and an opposite closing end, a top member and a pair of spaced legs depending from the top member; and (b) opening the mouth by:

(i) moving the slider to the notch;

(ii) pivoting the opening end of the slider toward the notch to position a separator plow at the opening end of the slider between the interlocking members, including moving a protrusion extending from one of the legs over an external portion of the zipper closure to receive a tactile indication the plow has been moved to the position between the interlocking members; and (iii) while the plow is between the interlocking members, moving the slider in an opening direction along the zipper closure to result in separation of the interlocking profiles.

20. The method of claim 19 wherein:

(a) the step of providing a slider on the zipper closure includes providing the slider in which said at least one leg of the slider has a first track-accommodating groove and a second track-accommodating groove; the first and second track-accommodating grooves being separated by the protrusion; and (b) the step of pivoting includes moving the slider so that the complementary profiles are re-positioned from the second track-accommodating groove to the first track-accommodating groove.

* * * * *